US005108886A

United States Patent [19]

Idogaki

[11] Patent Number: 5,108,886

[45] Date of Patent: Apr. 28, 1992

[54] SILVER HALIDE COLOR PHOTOGRAPHIC MATERIAL

[75] Inventor: Yoko Idogaki, Minami-ashigara, Japan

[73] Assignee: Fuji Photo Film Co., Ltd., Kanagawa, Japan

[21] Appl. No.: 628,629

[22] Filed: Dec. 11, 1990

[30] Foreign Application Priority Data

Dec. 18, 1989 [JP] Japan ..... 1-325897

[51] Int. Cl.[5] ..... G03C 7/388; G03C 7/38; G03C 1/34

[52] U.S. Cl. ..... 430/546; 430/551; 430/558

[58] Field of Search ..... 430/546, 558, 551

[56] References Cited

U.S. PATENT DOCUMENTS

| | | | |
|---|---|---|---|
| 3,700,455 | 10/1972 | Ishikawa et al. | 430/554 |
| 3,725,067 | 4/1973 | Bailey et al. | 430/558 |
| 4,540,654 | 9/1985 | Sato et al. | 430/381 |
| 4,621,046 | 11/1986 | Sato et al. | 430/381 |
| 4,865,963 | 9/1989 | Furutachi et al. | 430/558 |
| 4,882,266 | 11/1989 | Kawagishi et al. | 430/546 |
| 4,904,575 | 2/1990 | Ono et al. | 430/551 |
| 4,906,559 | 3/1990 | Nishijima et al. | 430/551 |

FOREIGN PATENT DOCUMENTS

| | | |
|---|---|---|
| 0355660 | 2/1990 | European Pat. Off. . |
| 61-84641 | 4/1986 | Japan . |
| 1252418 | 11/1971 | United Kingdom . |
| 1334515 | 10/1973 | United Kingdom . |

OTHER PUBLICATIONS

RD No 24220 (Jun. 1984).

*Primary Examiner*—Lee C. Wright

*Attorney, Agent, or Firm*—Birch, Stewart, Kolasch & Birch

[57] ABSTRACT

There is disclosed a silver halide color photographic material having at least one silver halide emulsion layer on a base, which comprises in the silver halide emulsion layer a magenta coupler represented by formula (I), which has been dispersed by using a chlorinated paraffin having 8 or more carbon atoms. The disclosure as described provides a color photographic material being excellent in color reproduction and having improved light-fastness of the magenta color image from the high density part to the low density part, even when the color photographic material is processed by the color developer contaminated by a small amount of bleaching solution formula (I):

wherein Za and Zb each represent =CH—, or =N—, $R_1$ represents a hydrogen atom or a substituent, $R_2$ represents a substituent, X represents a hydrogen atom or a group or an atom capable of being released, and i) when there is no $R_2$ in the molecule, $R_1$ represents a group bonded to the pyrazoloazole ring through a secondary or tertiary carbon atom, or ii) when there is $R_2$ in the molecule, at least one $R_2$ represents a group bonded to the pyrazoloazole ring through a secondary or tertiary carbon atom.

15 Claims, No Drawings

SILVER HALIDE COLOR PHOTOGRAPHIC MATERIAL

FIELD OF THE INVENTION

The present invention relates to a silver halide color photographic material, and more particularly to a silver halide color photographic material excellent in color reproduction, improved in light-fastness of the color image, and excellent in process stability.

BACKGROUND OF THE INVENTION

Subtractive color photography forms a color image by forming yellow, magenta, and cyan dyes respectively complementary to blue, green, and red, which result from the coupling of the respective yellow, magenta, and cyan dye-forming couplers with the oxidation product of an aromatic primary amine color-developing agent formed by reducing an exposed silver halide with the color-developing agent. Substantially nondiffusible couplers to be contained in photographic materials are generally dissolved in phosphate-type or phthalate-type high-boiling organic solvents substantially insoluble in water, and if desired cosolvents, and they are added to silver halide emulsions.

Nondiffusible couplers are required to have such basic properties that not only can they be developed to form dyes, but also their solubility in high-boiling organic solvents is high, their dispersibility and stability in silver halide photographic emulsions are good, and the light resistance, heat resistance, and humidity resistance of the image dyes formed therefrom are favorable.

Because the magenta dyes formed, for example, from 1H-pyrazolo[5,1-c][1,2,4]triazole-type couplers described in U.S. Pat. No. 3,725,067 and British Patent Nos. 1,252,418 and 1,334,515, 1H-pyrazolo[1,5-b][1,2,4]triazole-type couplers described in European Patent No. 119,860, 1H-pyrazolo[1,5-d]tetrazole-type couplers described in RD No. 24220 (June 1984), and 1H-pyrazolo[1,5-b]pyrazole-type couplers have less harmful subsidiary absorption near 430 nm, they are preferred in view of color reproduction, and they are also preferable in that they do not allow the color-unformed part to have yellow stain due to heat or humidity.

However, the light-fastness of the azomethine dyes formed from these couplers is low, which spoils the performance of color photographic materials, in particular print color photographic materials.

Further, these couplers have such problems that if the coupler is processed with a color developer into which a trace amount of a bleaching solution or a bleach-fix solution had accidentally been mixed during the processing thereof, resulting in an increase of the solubility of silver halides, the color-formed dye density lowers considerably and the sensitization decreased greatly.

JP-A (("JP-A" means unexamined published Japanese patent application) No. 84641/1986 describes that high-boiling chlorinated paraffins are used as coupler solvents to improve the dispersibility and the solubility in a color photographic material, to thereby improve the dye image stability. However, in this photographic material, the problem of lowering color-formed dye density due to contamination of color developer by a bleach-fix solution was not solved.

On the other hand, JP-A Nos. 65245/1986 and 89961/1987 describe that pyrazoloazole-type magenta couplers having at least one substituted-alkyl group as a substituent are improved in fastness to light and are excellent in color reproduction. However, these couplers have a defect that the process stability is poor. In particular, they have defects that even if a color developer that is not fatigued is used, when a very small amount of a bleaching solution or a bleach-fix solution (for example, one using EDTA ferric iron) is used in the color developer, the loss of the color-formed dyes is great and the color-formed dye density is reduced.

SUMMARY OF THE INVENTION

The first object of the present invention is to provide a silver halide photographic material excellent in color reproduction quality and remarkably improved in light-fastness of the magenta color image.

The second object of the present invention is to provide a silver halide photographic material whose color-formed dye density will be lost evenless when processed with a color developer into which a bleaching solution has been used during operation and which contains a pyrazoloazole-type coupler improved in light-fastness of dye image.

Other and further objects, features and advantages of the invention will appear more evident from the following description.

DETAILED DESCRIPTION OF THE INVENTION

The objects of the invention have been attained by the following technique.

(1) A silver halide color photographic material having at least one silver halide emulsion layer on a base, characterized in that said silver halide emulsion layer contains at least one coupler represented by the following formula (I):

Formula (I)

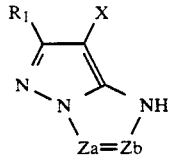

wherein Za and Zb each represent =CH—,

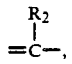

or =N—, $R_1$ represents a hydrogen atom or a substituent, $R_2$ represents a substituent, X represents a hydrogen atom or a group or an atom capable of being released upon the coupling reaction with the oxidized product of an aromatic primary amine developing agent, if Za=Zb is a carbon-carbon double bond, it is part of the aromatic ring, a dimer or more higher polymer may be formed through $R_1$, $R_2$, or X, if there are two or more $R_2$s in the molecule, they may be the same or different, and I) if there is no $R_2$ in the molecule, $R_1$ represents a group bonded to the pyrazoloazole ring through a secondary or tertiary carbon atom, or II) if there is $R_2$ in the molecule, at least one $R_2$ represents a group bonded to the pyrazoloazole ring through a secondary or tertiary carbon atom, which coupler has been dispersed by using at least one chlorinated paraffin having 8 or more of carbon atoms.

(2) A silver halide color photographic material as slated in (1), characterized in that said silver halide emulsion layer contains at least one compound represented by the following formula (II):

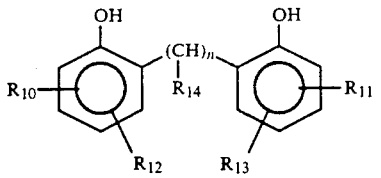

Formula (II)

wherein $R_{10}$, $R_{11}$, $R_{12}$, and $R_{13}$ each represent an alkyl group having 1 to 18 carbon atoms, $R_{14}$ represents a hydrogen or an alkyl group having 1 to 12 carbon atoms, n is an integer of 1 to 3, when n is 2 or 3, group $R_{14}$ may be the same or different, and when n is 1, $R_{14}$ is the above alkyl group.

Now the pyrazoloazole type couplers represented by formula (I) will be described in detail.

By "polymer" represented by formula (I) is meant a polymer having two or more groups represented by formula (I) in the molecule, which includes a bis-form and a polymer coupler. Herein the polymer may be a homopolymer, consisting of a monomer having a moiety represented by formula (I) (preferably a monomer having a vinyl group, which will be referred hereinafter to as vinyl monomer), or a copolymer formed by copolymerization of a monomer having a moiety represented by formula (I) with a non-color-forming ethylenically-unsaturated monomer that will not couple with the oxidized product of an aromatic primary amine color-developing agent.

The couplers represented by formula (I) are represented by formulae (I-1), (I-2), (I-3), (I-4), and (I-5) respectively:

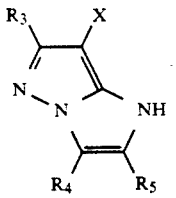

(I-1)

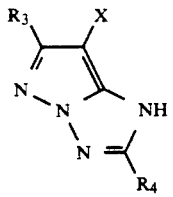

(I-2)

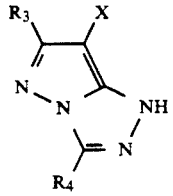

(I-3)

-continued

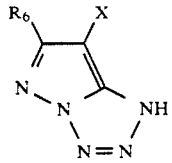

(I-4)

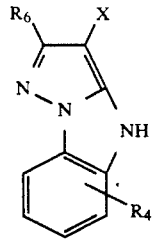

(I-5)

wherein $R_3$ and $R_6$ each correspond to $R_1$ in formula (I), and $R_4$ and $R_5$ each correspond to $R_2$ in formula (I).

Among the couplers represented by formulae (I-1) to (I-5), ones preferable for the purpose of the present invention are those represented by formulae (I-1), (I-2), and (I-3), with more preference given to those represented by formula (I-2).

Substituents $R_3$, $R_4$, and $R_5$ in formulae (I-1) to (I-3) each represent a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, or an aryloxycarbonyl group, and at least one of $R_3$ and $R_4$ in formula (I-1), $R_4$ in formulae (I-2) and (I-3), and $R_6$ in formulae (I-4) and (I-5) represents a group that bonds to the pyrazoloazole ring through a secondary or tertiary carbon atom, with particular preference given to the secondary carbon atom. The number of carbon atoms for substituents $R_3$, $R_4$, and $R_5$ above mentioned is 50 or less, preferably one of them being 10 to 50 carbon atoms.

X in formulae (I-1) to (I-5) represents a hydrogen atom, a halogen atom, a carboxy group, or a group capable of a coupling split-off that bonds to the carbon atom at the coupling site through an oxygen atom, a nitrogen atom, or a sulfur atom.

$R_3$, $R_4$, $R_5$, $R_6$, or X may be a bivalent group to form a bis-form. When a moiety represented by one of formulae (I-1) to (I-5) is present in a vinyl monomer, $R_3$, $R_4$, $R_5$, or $R_6$ represents simply a bond or a linking group, and through it a moiety represented by one of formulae (I-1) to (I-5) bonds to the vinyl group.

More particularly, $R_3$, $R_4$, and $R_4$ each represent a hydrogen atom, a halogen atom (e.g., chlorine and bromine), an alkyl group (e.g., methyl, propyl, hexyl, trifluoromethyl, tridecyl, 3-(2,4-di-t-amylphenoxy)propyl, 2-dodecyloxyethyl, 3-phenoxypropyl, 2-hexylsulfonylethyl, cyclopentyl, and benzyl), an aryl group (e.g., phenyl, 4-t-butylphenyl, 2,4-di-t-amylphenyl, and 4-tetradecaneamidophenyl), a heterocyclic group (e.g., 2-furyl, 2-thienyl, 2-pyrimidinyl, and 2-benzothiazolyl), a cyano group, an alkoxy group (e.g., methoxy, ethoxy, 2-methoxyethoxy, 2-dodecyloxyethoxy, and 2 methanesulfonylethoxy), an aryloxy group (e.g., phenoxy, 2-methylphenoxy, and 4-t-butylphenoxy), a heterocyclic oxy group (e.g., 2-benzimidazolyloxy), an acyloxy group (e.g., acetoxy and hexadecanoyloxy), a carbamoyloxy group (e.g., N-phenylcarbamoyloxy and N-ethylcarbamoyloxy), a silyloxy group (e.g., trimethylsilyloxy), a sulfonyloxy group (e.g., dodecylsulfonyloxy), an acylamino group (e.g., acetamido, benzamido, tetradecaneamido, α-(2,4-di-t-amylphenoxy)-butylamido, γ-(3-t-butyl-4-hydroxyphenoxy)-butylamido, and α-{4-(4-hydroxyphenylsulfonyl)-phenoxy}decaneamido), an anilino group (e.g., phenylamino, 2-chloroanilino, 2-chloro-5-tetradecaneanilino, 2-chloro-5-dodecyloxycarbonylanilino, N-acetylanilino, and 2 chloro-5-{α-(3-t-butyl-4hydroxyphenoxy)dodecaneamido}anilino), an ureido group (e.g., phenylureido, methylureido, N,N-dibutylureido), an imido group (e.g., N-succinimido, 3-benzylhydandoinyl, and 4-(2-ethylhexanoylamino)phthalimido), a sulfamoylamino group (e.g., N,N-dipropylsulfamoylamino and N-methyl-N-decylsulfamoylamino), an alkylthio group (e.g., methylthio, octylthio, tetradecylthio, 2-phenoxyethylthio, 3-phenoxypropylthio, and 3-(4-t-butylphenoxy)propylthio), an arylthio group (e.g., phenylthio, 2-butoxy-5-t-octylphenylthio, 3-pentadecylphenylthio, 2-carboxyphenylthio, and 4-tetradecaneamidophenylthio), a heterocyclic thio group (e.g., 2-benzothiazoylthio), an alkoxycarbonylamino group (e.g., methoxycarbonylamino and tetradecyloxycarbonylamino), an aryloxycarbonylamino group (e.g., phenoxycarbonylamino and 2,4-di-tert-butylphenoxycarbonylamino), a sulfonamido group (e.g., methanesulfonamido, hexadecanesulfonamido, benzenesulfonamido, p-toluenesulfonamido, octadecanesulfonamido, and 2-methyloxy-5-t-butylbenzenesulfonamido), a carbamoyl group (e.g., N-ethylcarbamoyl, N,N-dibutylcarbamoyl, N-(2-dodecyloxyethyl)carbamoyl, N-methyl-N-dodecylcarbamoyl, and N-{3-(2,4-di-tert-amylphenoxy)propyl}carbamoyl), an acyl group (e.g., acetyl, (2,4-di-tert-amylphenoxy)acetyl, and benzoyl), a sulfamoyl group (e.g., N-ethylsulfamoyl, N,N-dipropylsulfamoyl, N-(2-dodecyloxyethyl)sulfamoyl, N-ethyl-N-dodecylsulfamoyl, and N,N-diethylsulfamoyl), a sulfonyl group (e.g., methanesulfonyl, octanesulfonyl, benzenesulfonyl, and toluenesulfonyl), a sulfinyl group (e.g., octanesulfinyl, dodecylsulfinyl, and phenylsulfinyl), an alkoxycarbonyl group (e.g., methoxycarbonyl, butyloxycarbonyl, dodecylcarbonyl, and octadecylcarbonyl), or an aryloxycarbonyl group (e.g., phenyloxycarbonyl and 3-pentadecyloxycarbonyl).

At least one of $R_3$, $R_4$, and $R_5$ and $R_6$ each represent a group that bonds through a secondary or tertiary carbon atom to the pyrazoloazole ring such as an isopropyl group, a t-butyl group, a t-hexyl group, a cyclohexyl group, an adamantyl group, a 1-ethoxyisopropyl group, a 1-phenoxy-1,1-dimethylmethyl group, an α,α-dimethylbenzyl group, an α,α-dimethylphenylethyl group, an α-ethylbenzyl group, a 1-ethyl-1-[4-(2-butoxy-5-tert-octylbenzenesulfonamido)phenyl]methyl group, a 1-methyl-2-[4-(4-dodecyloxybenzenesulfonamido)phenyl]ethyl group, a 1-methyl-2-(2-octyloxy-5-tert-octylbenzenesulfonamido)ethyl group, a 1,1-dimethyl-2-(2-octyloxy-5-tert-octylbenzenesulfonamido)ethyl group, a 1-methyl-2-[2-octyloxy-5-(2-octyloxy-5-tert-octylbenzenesulfonamido)benzenesulfonamido]ethyl group, a 1-ethyl-2-(2-dodecyloxy-5-tert-octylbenzenesulfonamido)ethyl group, and a 1-(2-hydroxyethyl)-2-{α-[3-(2-octyloxy-5- tert-octylbenzenesulfonamido)phenoxy]dodecaneamido}ethyl group.

More particularly, X represents a hydrogen atom, a halogen atom (e.g., chlorine, bromine, and iodine), a carboxyl group, a group that links through an oxygen atom (e.g., acetoxy, propanoyloxy, benzoyloxy, 2,4-dichlorobenzoyloxy, ethoxyoxazoyloxy, pyruvinyloxy, cinnamoyloxy, phenoxy, 4-cyanophenoxy, 4-methanesulfonamidophenoxy, 4-methanesulfonylphenoxy, α-naphthoxy, 3-pentadecylphenoxy, benzyloxycarbonyloxy, ethoxy, 2 cyanoethoxy, benzyloxy, 2-phenetyloxy, 2-phenoxyethoxy, 5-phenyltetrazolyloxy, and 2-benzothiazolyloxy), a group that links through a nitrogen atom (e.g., benzenesulfonamido, N-ethyltoluenesulfonamido, heptafluorobutaneamido, 2,3,4,5,6-pentafluorobenzamido, octanesulfonamido, p-cyanophenylureido, N,N-diethylsulfamoylamino, 1-piperidyl, 5,5-dimethyl-2,4-dioxo-3-oxazolidinyl, 1-benzyl-ethoxy-3-hydantoinyl, 2N-1,1-dioxo-3(2H)-oxo-1,2-benzoisothiazolyl, 2-oxo-1,2-dihydro-1-pyridinyl, imidazolyl, pyrazolyl, 3,5-diethyl-1,2,4-triazol-1-yl, 5- or 6-bromo-benzotriazol-1-yl, 5-methyl-1,2,3,4-triazol-1-yl, benzimidazolyl, 3-benzyl-1-hydantoinyl, 1-benzyl-5-hexadecyloxy-3-hydantoinyl, 5-methyl-1-tetrazolyl, 4-methoxyphenylazo, 4-pivaloylaminophenylazo, and 2-hydroxy-4-propanoylphenylazo), or a group that links through a sulfur atom (e.g., phenylthio, 2-carboxyphenylthio, 2-methoxy-5-t-octylphenylthio, 4-methanesulfonylphenylthio, 4-octanesulfonamidophenylthio, 2-butoxyphenylthio, 2-(2-hexanesulfonylethyl)-5-tert-octylphenylthio, benzylthio, 2-cyanoethylthio, 1-ethoxycarbonyltridecylthio, 5-phenyl-2,3,4,5-tetrazolylthio, 2-benzothiazolylthio, 2-dodecylthio-5-thiophenylthio, and 2-phenyl-3-dodecyl-1,2,4-triazolyl-5-thio).

When $R_3$, $R_4$, $R_5$, or X is a bivalent group to form a bis-form, the bivalent group is more particularly a substituted or unsubstituted alkylene group (e.g., methylene, ethylene, 1-ethylethylene, 1,10-decylene, or —$CH_2CH_2$—O—$CH_2CH_2$—), a substituted or unsubstituted phenylene group (e.g., 1,4-phenylene, 1,3-phenylene,

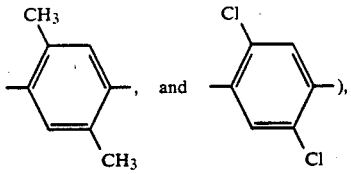

or a group —NHCO—$R_7$—CONH— (wherein $R_7$ represents a substituted or unsubstituted alkylene group or phenylene group).

When $R_6$ represents a bivalent group to form a bis-form, the bivalent group is a group wherein the above alkylene group bonds through a secondary or tertiary carbon atom to the pyrazoloazole ring.

When those represented by formulae (I-1) to (I-5) are in a vinyl monomer, the linking group represented by $R_3$, $R_4$, or $R_5$ includes a group formed by combining those selected from an alkylene group, which may be substituted (e.g. methylene, ethylene, 1-methylethylene, 1,10-decylene, and —$CH_2CH_2OCH_2CH_2$—), a phenylene group, which may be substituted (e.g., 1,4-phenylene, 1,3-phenylene,

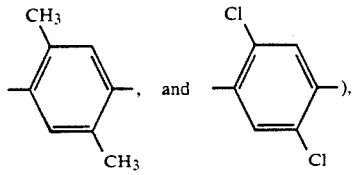

—NHCO—, —CONH—, —O—, —OCO— and an aralkylene group

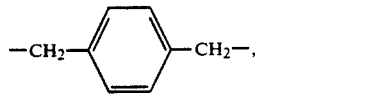

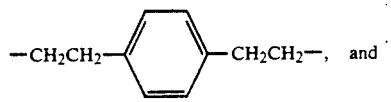

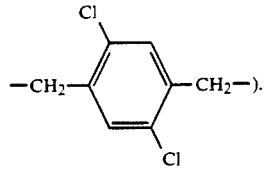

The alkylene linking group represented by $R_6$ represents a group wherein the above alkylene group bonds through a secondary or tertiary carbon atom to the pyrazoloazole ring.

The vinyl group present in the vinyl monomer includes substituted ones in addition to those represented by formula (I-1) to (I-5). Preferable substituents are a hydrogen atom, a chlorine atom, and lower alkyl groups having 1 to 4 carbon atoms.

The non-color forming ethylenically-unsaturated monomer that will not couple with the oxidation product of aromatic primary amine developing agents includes, for example, acrylic acid, α-chloroacrylic acid, α-alacrylic acid (e.g., methacrylic acid), esters and amides derived from these acrylic acids (e.g., acrylamide, n-butyl acrylamide, t-butyl acrylamide, diacetone acrylamide, methacrylamide, methyl acrylate, ethyl acrylate, n-propyl acrylate, n-butyl acrylate, t-butyl acrylate, iso-butyl acrylate, 2-ethylhexyl acrylate, n-octyl acrylate, lauryl acrylate, methyl methacrylate, ethyl methacrylate, n-butyl methacrylate, and β-hydroxy methacrylate), methylene dibisacrylamide, vinyl esters (e.g., vinyl acetate, vinyl propionate and vinyl laurate), acrylonitrile, methacrylonitrile, aromatic vinyl compounds (e.g., styrene and its derivatives, vinyltoluene, divinylbenzene, vinylacetophenone, and sulfostyrene), itaconic acid, citraconic acid, crotonic acid, vinylidene chloride, vinyl alkyl ethers (e.g., vinyl ethyl ether), maleic acid, maleic anhydride, maleates, N-vinyl-2-pyrrolidone, N-vinylpyridine, and 2- and 4-vinylpyridines, two or more which may be used in combination.

Examples of the coupler within the scope of the present invention are shown below, but the present invention is not limited to them.

(P-1)

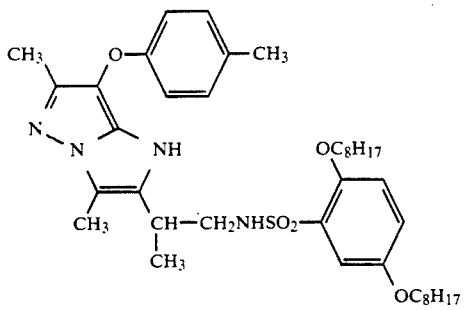

(P-2)

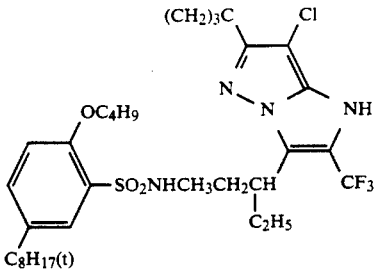

(P-3)

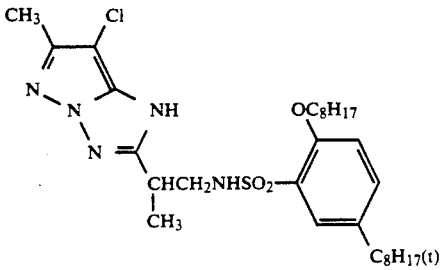

-continued
(P-4)
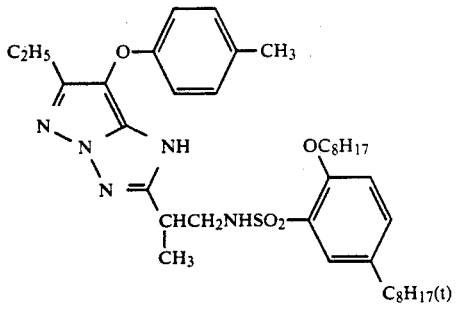
(P-5)
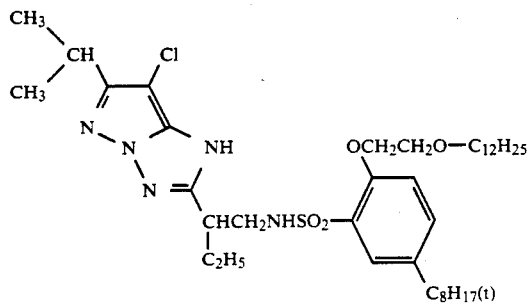
(P-6)
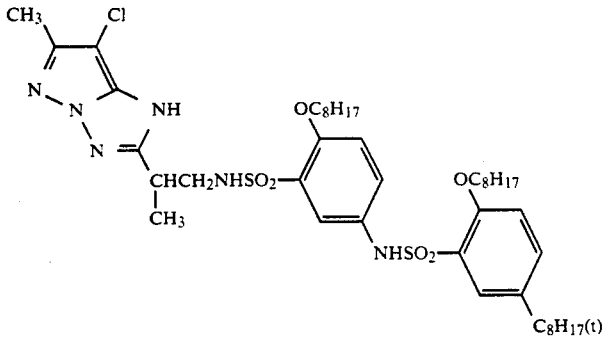
(P-7)
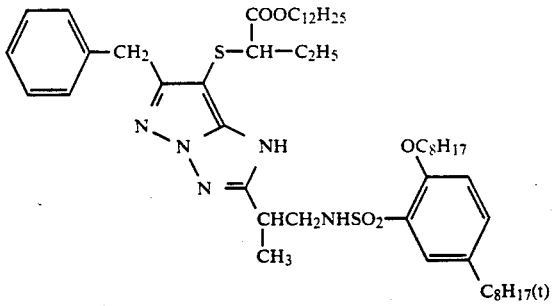
(P-8)
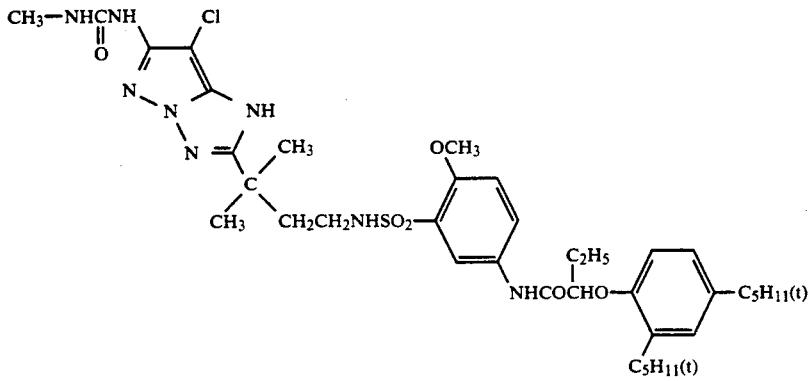

-continued
(P-9)
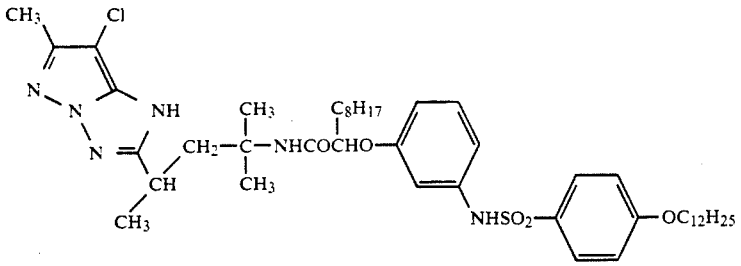
(P-10)
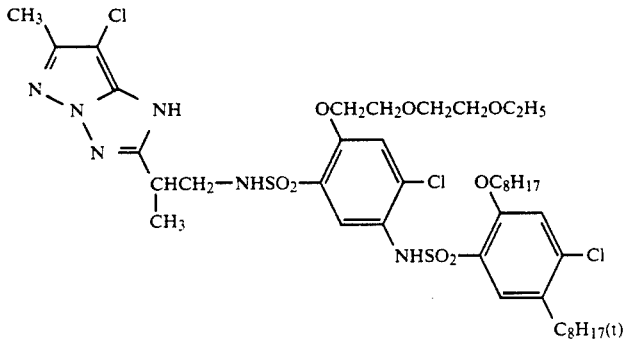
(P-11)
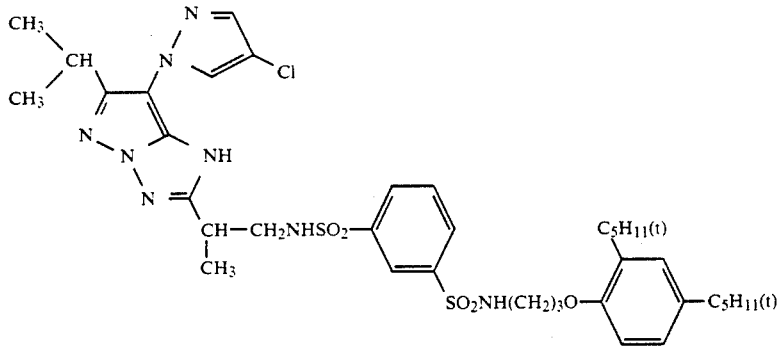
(P-12)
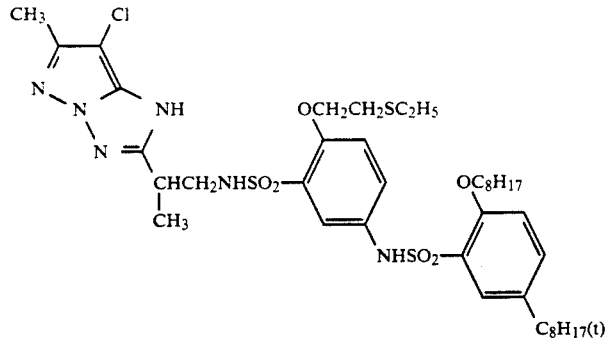
(P-13)
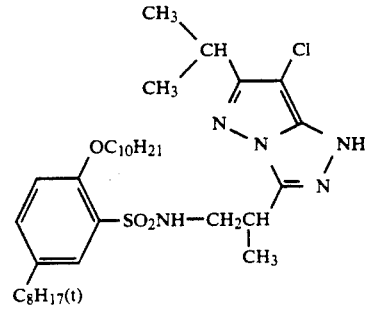

-continued
(P-14)
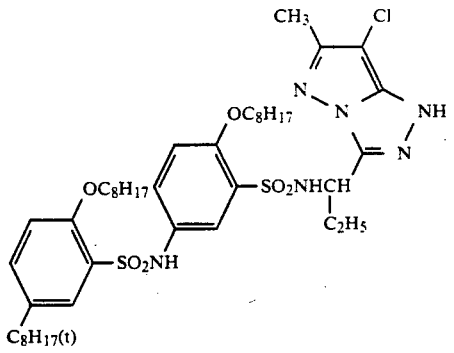
(P-15)
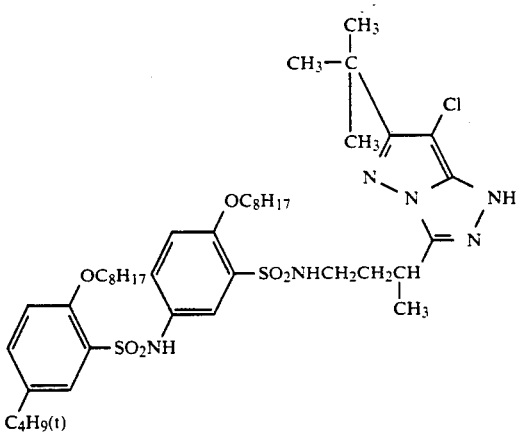
(P-16)
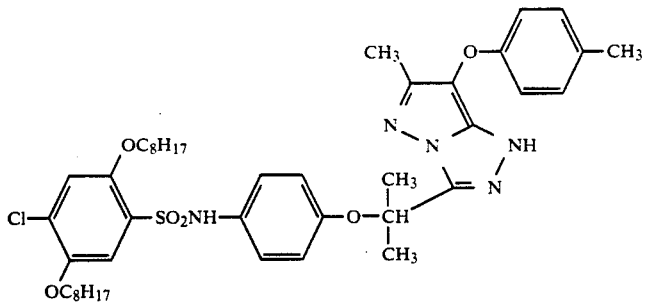
(P-17)
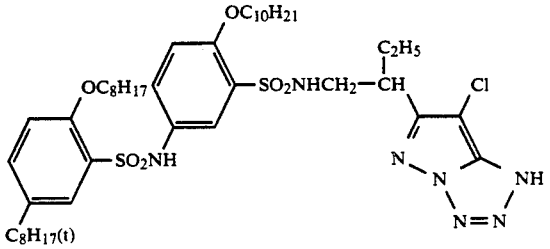

-continued
(P-18)
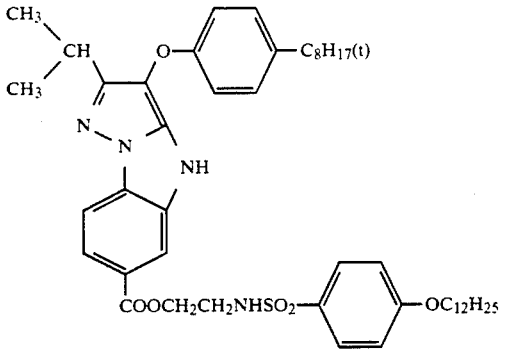
(P-19)
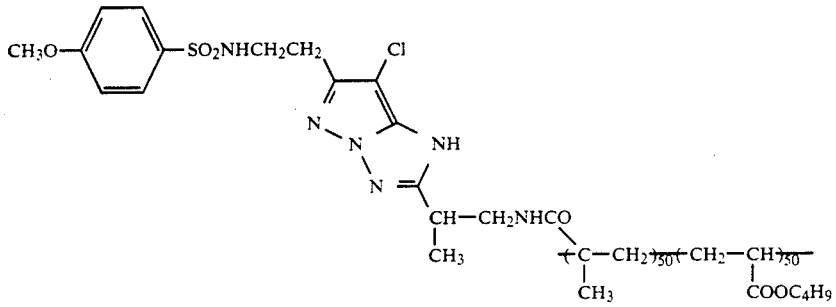
(P-20)
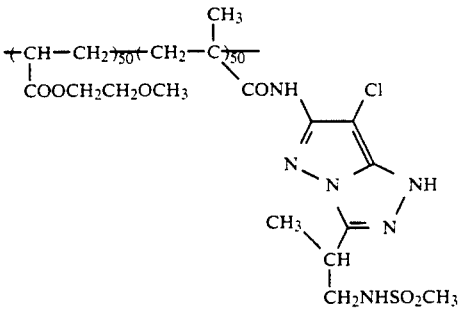
(P-21)
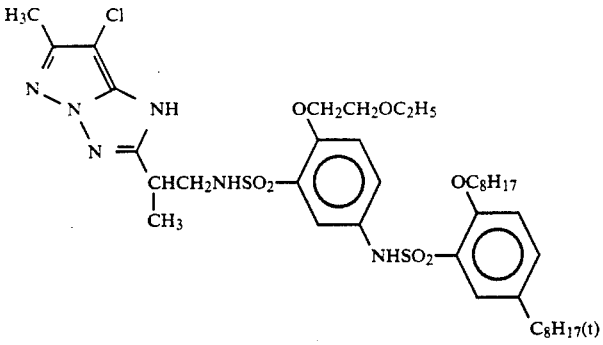
(P-22)
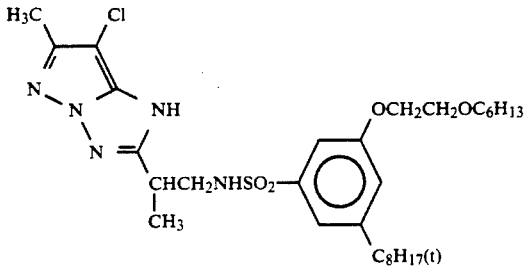

-continued
(P-23)
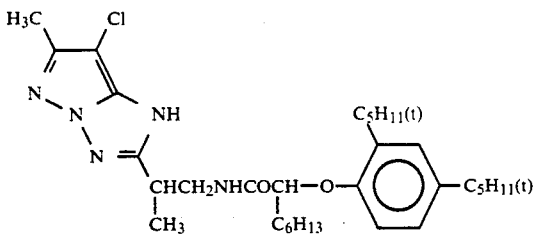
(P-24)
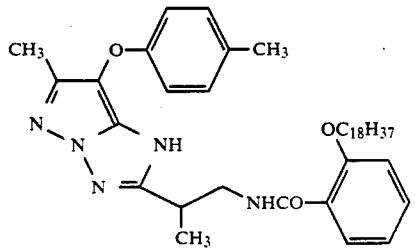
(P-25)
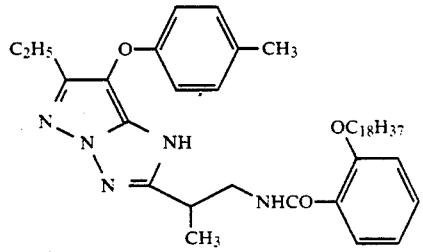
(P-26)
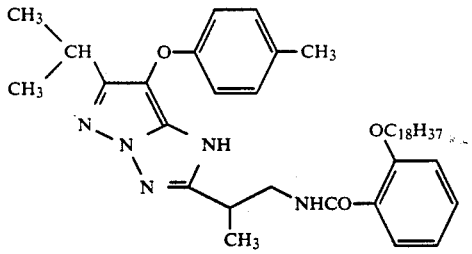
(P-27)
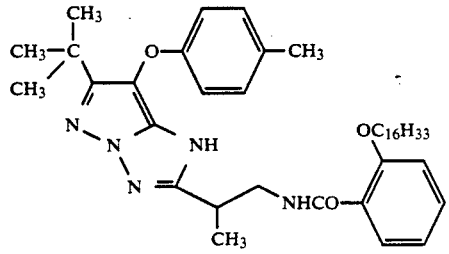

-continued (P-28)

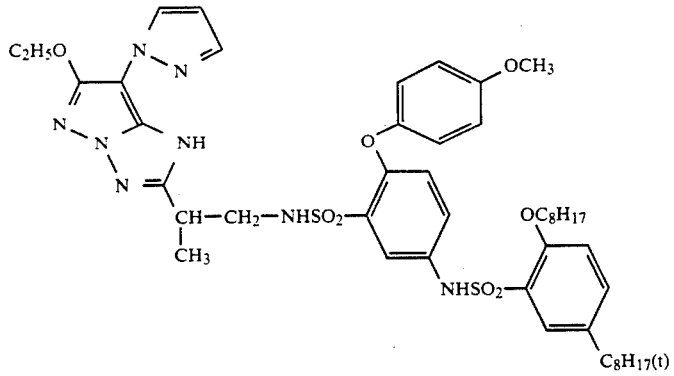

(P-29)

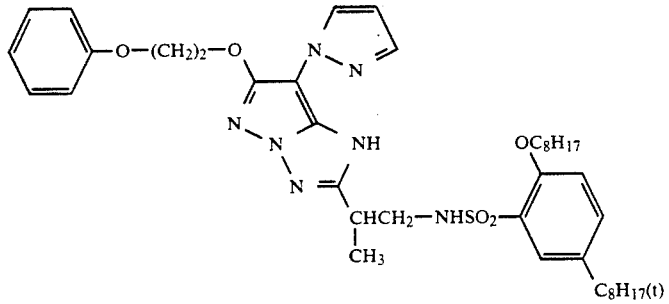

(P-30)

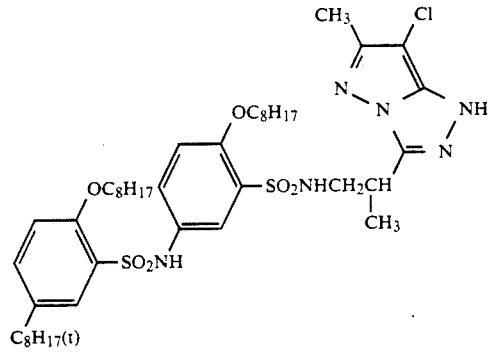

Couplers represented by formulae (I-1) to (I-5) of the present invention can be synthesized in accordance with methods described in the literature mentioned below.

Synthesis processes for compounds of formula (I-1) are described, for example, in JP-A No. 162548/1984, synthesis processes for compounds of formula (I-2) are described, for example, in JP-A No. 171956/1984, synthesis processes for compounds of formula (I-3) are described, for example, in U.S. Pat. No. 3,725,067, synthesis processes for compounds of formula (I-4) are described, for example, in JP-A No. 33552/1985, and synthesis processes for compounds of formula (I-5) are described, for example, in U.S. Pat. Nos. 3,061,432 and 3,369,597.

The chlorinated paraffin used in the present invention may be chlorinated straight-chain, branched, or cyclic paraffins, polymers obtained from a chlorine-substituted unsaturated hydrocarbon, such as vinyl chloride, vinylidene chloride, and ally chloride, or copolymers obtained from these monomers and other olefins, which may be used in combination. The number of carbon atoms in the chlorinated paraffins is 8 or over, and the molecular weight thereof is preferably between 250 and 10,000. The boiling point of the chlorinated paraffins is preferably 175° C. or over at atmospheric pressure. The amount by weight of the chlorine contained in the chlorinated paraffin is 10% or over, and more preferably 30 to 80%, on average. Specific examples of the chlorinated paraffin used in the present invention are shown below in terms of average composition, average molecular weight, and average chlorine content.

| Compound Example | Average composition | Average molecular weight | Average chlorine content |
|---|---|---|---|
| (S-1) | $C_{24}H_{44}Cl_6$ | 545 | 40% |
| (S-2) | $C_{24}H_{45}Cl_7$ | 580 | 42% |
| (S-3) | $C_{14}H_{25.5}Cl_{4.5}$ | 350 | 45% |
| (S-4) | $C_{14}H_{24}Cl_6$ | 400 | 50% |
| (S-5) | $C_{12}H_{18}Cl_8$ | 450 | 64% |
| (S-6) | $C_{24}H_{29}Cl_{21}$ | 1060 | 70% |

Two or more of the chlorinated paraffins according to the present invention can be used in combination.

The effect of chlorinated paraffins in the present invention is that the density of color-formed dye is not lowered even when the bleaching solution or bleach-fix solution contaminates the color developer.

The amount of the chlorinated paraffin to be used is generally 0.1 g to 20 g, preferably 0.3 g to 5 g, and more preferably 1.0 to 3.7 g, per g of total amount of magenta couplers. If the amount of the chlorinated paraffin is too small, the speed of the color formation of the coupler becomes too low, the density of the color formation becomes low, and the process stability becomes poor. On the other hand, if the amount of the chlorinated paraffin is excessive, the amount of oil in the photographic material increases and the strength of the film lowers.

If required, the chlorinated paraffin of the present invention may be used in an admixture with a customarily used high-boiling organic solvent. In this case, as the high-boiling organic solvent used in combination with the chlorinated paraffin, those represented by the following formulae (III) to (VII) are preferable.

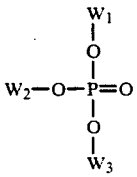

Formula (III)

$W_1-COOW_2$ Formula (IV)

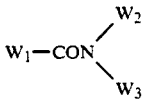

Formula (V)

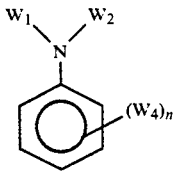

Formula (VI)

$W_1-O-W_2$ Formula (VII)

wherein $W_1$, $W_2$, and $W_3$ each represent a substituted or unsubstituted, alkyl group, cycloalkyl group, alkenyl group, aryl group, or heterocyclic group, $W_4$ represents $W_1$, O—$W_1$ or S—$W_1$, n is an integer of 1 to 5, when n is 2 or over, $W_4$ groups may be the same or different, and in formula (VII), $W_1$ and $W_2$ may together form a condensed ring.

Of compounds represented by formulae (III) to (VII), compounds represented by formulae (III), (IV), and (V) are preferable. The boiling point of the compound is preferably 160° C. or over.

Specific examples of high-boiling organic solvent are shown below, but the invention is not limited to them.

$O=P(OC_4H_9)_3$ (O-1)

(O-2)

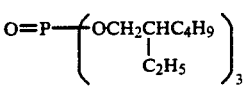

$O=P(OC_6H_{3-n})_3$ (O-3)

(O-4)

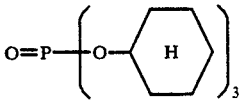

-continued (O-5)

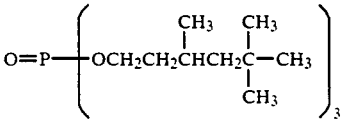

(O-6)

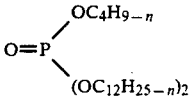

(O-7)

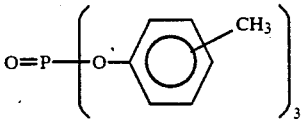

(O-8)

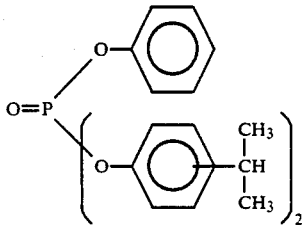

(O-9)

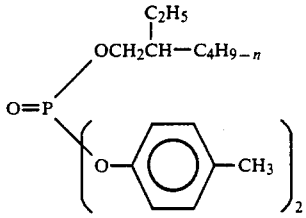

(O-10)

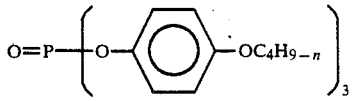

(O-11)

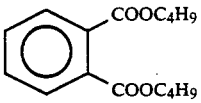

(O-12)

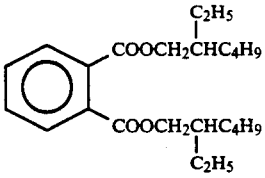

(O-13)

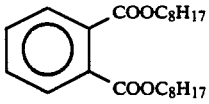

(O-14)

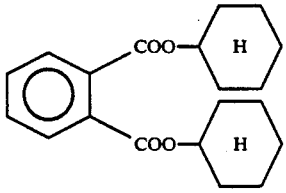

-continued

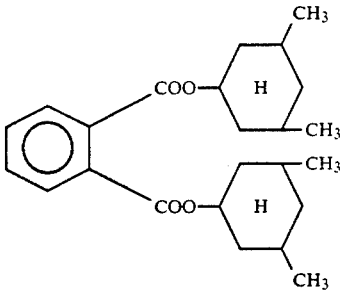

(O-15)

$C_{11}H_{23}CON(C_2H_5)_2$ (O-16)

The coupler represented by formula (I) is contained in the silver halide emulsion layer generally in an amount of 0.1 to 1.0 mol, preferably 0.1 to 0.5 mol, per mol of the silver halide.

It is preferable that the coupler represented by formula (I) of the present invention is dissolved, if required, together with a co-solvent (e.g., a low-boiling organic solvent, such as ethyl acetate), in a high-boiling organic solvent containing at least one chlorinated paraffin, the solution is emulsified and dispersed into an aqueous gelatin solution while stirring, the resulting emulsified dispersion is mixed with a silver halide emulsion, and the mixture is contained into a coating liquid for a silver halide emulsion layer.

Herein the term "organic co-solvent" means an organic solvent that is useful for emulsification and dispersion and that will eventually be removed substantially from the photographic material in the drying step after application or by the above method, which is a low-boiling organic solvent or a solvent that can dissolve in water to some degree and that can be eliminated by washing with water or the like.

In the present invention, various photographic hydrophobic substances can be contained in the silver halide emulsion layer.

As examples of the photographic hydrophobic substance, colored couplers, non-dye-forming couplers, developers, developer precursors, development-inhibitor precursors, ultraviolet absorbers, development accelerators, contrast controls, such as hydroquinones, dyes, dye releasers, antioxidants, brightening agents, fading inhibitors, and image stabilizers can be mentioned.

Of these, as an image stabilizer, at least one compound represented by formula (II) is preferably used.

In the present invention, although the compound represented by formula (II) may be emulsified separately from the coupler by using a high-boiling organic solvent, preferably the compound and the coupler are coemulsified.

The compounds represented by formula (II) will be described in more detail.

In formula (II), the alkyl group represented by $R_{10}$, $R_{11}$, $R_{12}$, $R_{13}$, and $R_{14}$ includes a substituted or unsubstituted straight-chain, branched, or cyclic alkyl group. As the substituents of the substituted alkyl group, those listed for the couplers described above can be mentioned. Preferably the total number of carbon atoms of each of the alkyl groups $R_{10}$ to $R_{14}$ is 6 or over but up to 32, and the total number of carbon atoms of the alkyl group $R_{14}$ is 3 to 12. More preferably, each of $R_{10}$ and $R_{11}$ is a methyl group.

Among compounds represented by formula (II), ones represented by the following formula (II-a) are preferable in the present invention.

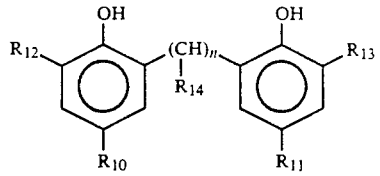

wherein $R_{10}$ to $R_{14}$ have the same meanings as those in formula (II).

The compounds represented by formula (II) of the present invention are added in an amount of 1 to 100 mol %, and preferably 1 to 30 mol % for the total amount of magenta couplers. Preferably these compounds are coemulsified with the magenta coupler.

Specific examples of the compound represented by formula (II) used in the present invention are listed below, but the present invention is not limited to them.

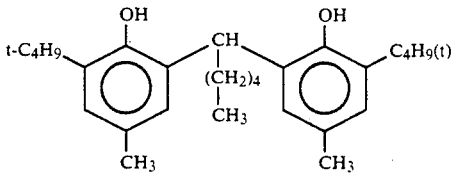

(II-1)

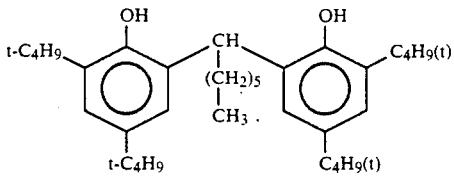

(II-2)

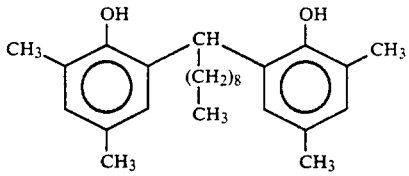

(II-3)

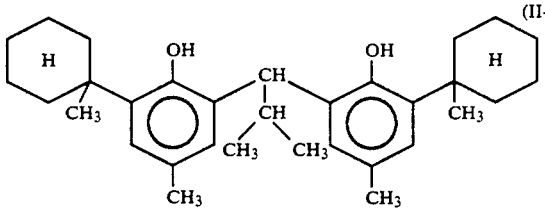

(II-4)

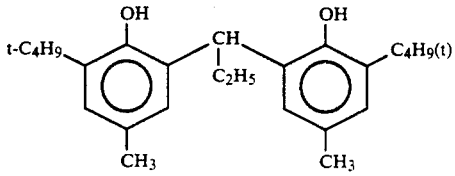

(II-5)

-continued (II-6)

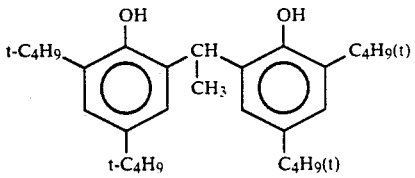

(II-7)

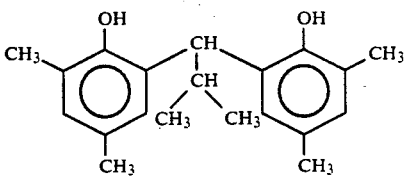

(II-8)

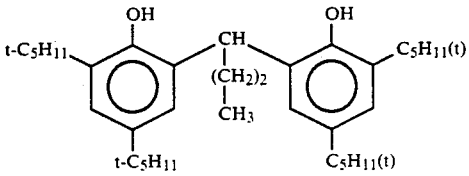

(II-9)

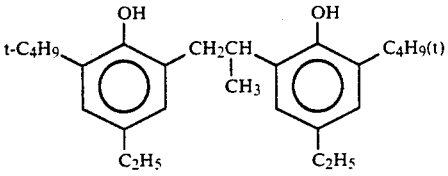

(II-10)

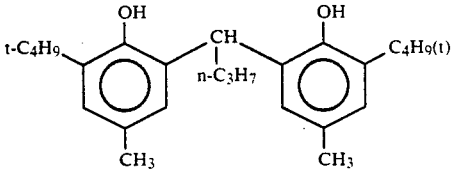

(II-11)

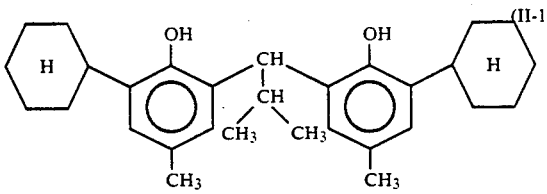

(II-12)

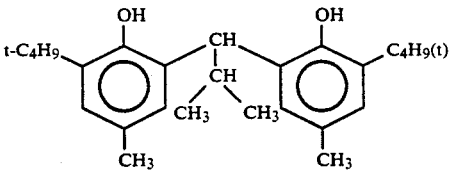

(II-13)

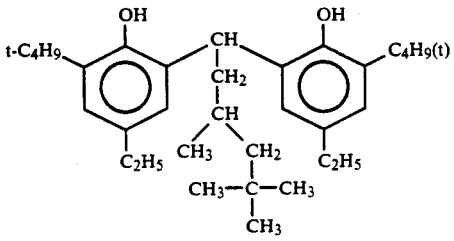

-continued (II-14)

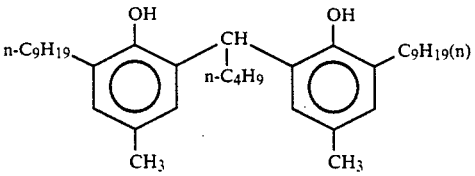

(II-15)

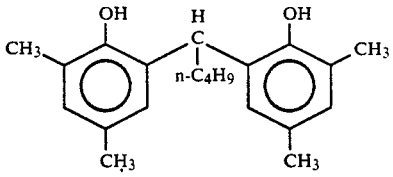

(II-16)

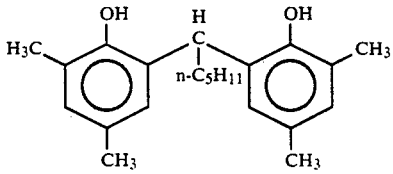

(II-17)

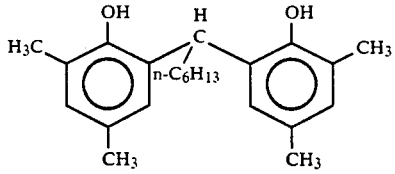

(II-18)

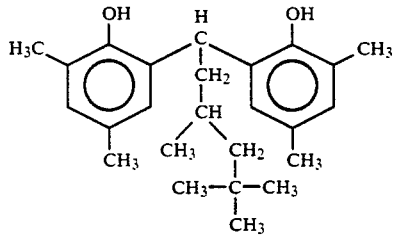

The color photographic material of the present invention can be constituted by applying at least each of a blue-sensitive silver halide emulsion layer, a green-sensitive silver halide emulsion layer, and a red-sensitive silver halide emulsion layer on a base. For common color print papers, the above silver halide emulsion layers are applied in the above-stated order on the base, but the order may be changed. Color reproduction by the subtractive color process can be performed by incorporating, into these photosensitive emulsion layers, silver halide emulsions sensitive to respective wavelength ranges, and so-called colored-couplers capable of forming dyes complementary to light to which the couplers are respectively sensitive, that is, capable of forming yellow complementary to blue, magenta complementary to green, and cyan complementary to red. However, the constitution may be such that the photosensitive layers and the color formed from the couplers do not have the above relationship.

As the silver halide emulsion used in the present invention, one comprising silver chlorobromide or silver chloride and being substantially free from silver iodide can be preferably used. Herein the term "substantially free from silver iodide" means that the silver iodide content is 1 mol % or below, and preferably 0.2 mol % or below. Although the halogen compositions of the emulsions may be the same or different from grain to grain, if emulsions whose grains have the same halogen composition are used, it is easy to make the properties of the grains homogeneous. With respect to the halogen composition distribution in a silver halide emulsion grain, for example, a grain having a so-called uniform-type structure, wherein the composition is uniform throughout the silver halide grain, a grain having a so-called layered-type structure, wherein the halogen composition of the core of the silver halide grain is different from that of the shell (which may comprises a single layer or layers) surrounding the core, or a grain having a structure with nonlayered parts different in halogen composition in the grain or on the surface of the grain (if the nonlayered parts are present on the surface of the grain, the structure has parts different in halogen composition joined onto the edges, the corners, or the planes of the grain) may be suitably selected and used. To secure high sensitivity, it is more advantageous to use either of the latter two than to use grains having a uniform-type structure, which is also preferable in view of the pressure resistance. If the silver halide grains have the above-mentioned structure, the boundary section between parts different in halogen composition may be a clear boundary, or an unclear boundary, due to the formation of mixed crystals caused by the difference in composition, or it may have positively varied continuous structures.

As to the silver halide composition of these silver chlorobromide emulsions, the ratio of silver bromide/-silver chloride can be selected arbitrarily. That is, the ratio is selected from a broad range in accordance with the desired purpose, but the ratio of silver chloride in a silver chlorobromide is preferably 2% or over.

Further in the photographic material suitable for the rapid processing of an emulsion of high silver chloride content so-called a high-silver-chloride emulsion may be preferably used. The content of silver chloride of the high-silver-chloride emulsion is preferably 90 mol % or over, more preferably 95 mol % or over.

In these high-silver-chloride emulsions, the structure is preferably such that the silver bromide localized phase in the layered form or nonlayered form is present in the silver halide grain and/or on the surface of the silver halide grain as mentioned above. The silver bromide content of the composition of the above-mentioned localized phase is preferably at least 10 mol %, and more preferably over 20 mol %. The localized phase may be present in the grain, or on the edges, or corners of the grain surfaces, or on the planes of the grains, and a preferable example is a localized layer epitaxially grown on each corner of the grain.

On the other hand, for the purpose of suppressing the lowering of the sensitivity as much as possible when the photographic material undergoes pressure, even in the case of high-silver-chloride emulsions having a silver chloride content of 90 mol % or over, it is preferably also practiced to use grains having a uniform-type structure, wherein the distribution of the halogen composition in the grain is small.

In order to reduce the replenishing amount of the development processing solution, it is also effective to increase the silver chloride content of the silver halide emulsion. In such a case, an emulsion whose silver chloride is almost pure, that is, whose silver chloride content is 98 to 100 mol %, is also preferably used.

The average grain size of the silver halide grains contained in the silver halide emulsion used in the present invention (the diameter of a circle equivalent to the projected area of the grain is assumed to be the grain size, and the number average of grain sizes is assumed to be an average grain size) is preferably 0.1 to 2 μm.

Further, the grain size distribution thereof is preferably one that is a so-called monodisperse dispersion, having a deviation coefficient (obtained by dividing the standard deviation of the grain size by the average grain size) of 20% or below, and desirably 15% or below. In this case, for the purpose of obtaining one having a wide latitude, it is also preferable that monodisperse emulsions as mentioned above are blended to be used in the same layer, or are applied in layers.

As to the shape of the silver halide grains contained in the photographic emulsion, use can be made of grain in a regular crystal form, such as cubic, tetradecahedral, or octahedral, or grains in an irregular crystal form, such as spherical or planar, or grains that are a composite of these. Also, a mixture of silver halide grains having various crystal forms can be used. In the present invention, of these, grains containing grains in a regular crystal form in an amount of 50% or over, preferably 70% or over, and more preferably 90% or over, are preferred.

Further, besides those mentioned above, an emulsion wherein the tabular grains having an average aspect ratio (the diameter of a circle calculated/the thickness) of 5 or over, and preferably 8 or over, exceed 50% of the total of the grains in terms of the projected area, can be preferably used.

The silver chloromide emulsion used in the present invention can be prepared by methods described, for example, by P. Glafkides, *in Chimie et Phisique Photographique* (published by Paul Montel, 1967), by G. F. Duffin in *Photographic Emulsion Chemistry* (published by Focal Press, 1966), and by V. L. Zelikman et al. in *Making and Coating Photographic Emulsion* (published by Focal Press, 1964). That is, any of the acid process, the neutral process, the ammonia process, etc. can be used, and to react a soluble silver salt and a soluble halide, for example, any of the single-jet process, the double-jet process, or a combination of these can be used. A process of forming grains in an atmosphere having excess silver ions (the so-called reverse precipitation process) can also be used. A process wherein the pAg in the liquid phase where a silver halide is to be formed is kept constant, that is, the so-called controlled double-jet process, can be used as one type of double-jet process. According to the controlled double-jet process, a silver halide emulsion wherein the crystal form is regular and the grain sizes are nearly uniform can be obtained.

Into the silver halide emulsion used in the present invention, various polyvalent metal ion impurities can be introduced during the formation or physical ripening of the emulsion grains. Examples of such compounds to be used include salts of cadmium, zinc, lead, copper, and thallium, and salts or complex salts of an element of Group VIII, such as iron, ruthenium, rhodium, palladium, osmium, iridium, and platinum. Particularly, the elements of Group VIII can be preferably used. Although the amount of these compounds to be added varies over a wide range according to the purpose, preferably the amount is $10^{-9}$ to $10^{-2}$ mol for the silver halide.

The silver halide emulsion used in the present invention is generally chemically sensitized and spectrally sensitized.

As the chemical sensitization method, sulfur sensitization, wherein typically an unstable sulfur compound is added, noble metal sensitization, represented by gold sensitization, or reduction sensitization can be used alone or in combination. As the compounds used in the chemical sensitization, preferably those described in JP-A No. 215272/1987, page 18 (the right lower column) to page 22 (the right upper column), are used.

The spectral sensitization is carried out for the purpose of providing the emulsions of the layers of the photographic material of the present invention with spectral sensitivities in desired wavelength regions. In the present invention, the spectral sensitization is preferably carried out by adding dyes that absorb light in the wavelength ranges corresponding to the desired spectral sensitivities, that is, by adding spectrally sensitizing dyes. As the spectrally sensitizing dyes used herein, for example, those described by F. M. Harmer in "Heterocyclic compounds—Cyanine dyes and related compounds" (published by John Wiley & Sons [New York, London], 1964) can be mentioned. As specific examples of the compounds and the spectral sensitization method, those described in the above JP-A No. 215272/1987, page 22 (the right upper column) to page 38, are preferably used.

In the silver halide emulsion used in the present invention, various compounds or their precursors can be added for the purpose of stabilizing the photographic performance or preventing fogging that will take place during the process of the production of the photographic material, or during the storage or photographic processing of the photographic material. As specific examples of these compounds, those described in the above-mentioned JP-A No. 215272/1987, pages 39 to 72, are preferably used.

As the emulsion used in the present invention, use is made of a so-called surface-sensitive emulsion, wherein a latent image is formed mainly on the grain surface, or of a so-called internal-image emulsion, wherein a latent image is formed mainly within the grains.

When the present invention is used for color photographic materials, generally in the color photographic material are used a yellow coupler, a magenta coupler, and a cyan coupler, which will couple with the oxidized product of the aromatic amine color-developing agent to form yellow, magenta, and cyan dye images.

Cyan couplers, magenta couplers, and yellow couplers preferably used in the present invention are those represented by the following formulae (C-I), (C-II), (M-I), and (Y):

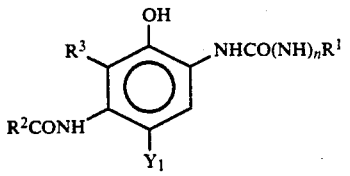

Formula (C-I)

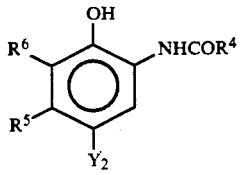

Formula (C-II)

-continued

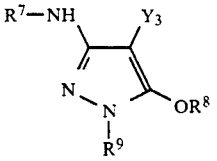

Formula (M-I)

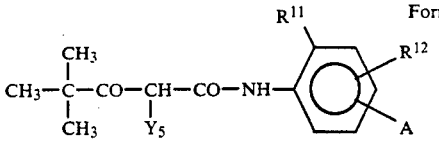

Formula (Y)

In formulae (C-I) and (C-II), $R^1$, $R^2$, $R^4$ each represent a substituted or unsubstituted aliphatic, aromatic, or heterocyclic group, $R^3$, $R^5$, and $R^6$ each represent a hydrogen atom, a halogen atom, an aliphatic group, an aromatic group, or an acylamino group, $R^3$ and $R^2$ together may represent a group of nonmetallic atoms to form a 5- or 6-membered ring, $Y_1$ and $Y_2$ each represent a hydrogen atom or a group that is capable of coupling off with the oxidation product of a developing agent, and n is 0 or 1.

In formula (C-II), $R^5$ preferably represents an aliphatic group such as a methyl group, an ethyl group, a propyl group, a butyl group, a pentadecyl group, a tert-butyl group, a cyclohexyl group, a cyclohexylmentyl group, a phenylthiomethyl group, a dodecyloxyphenylthiomethyl group, a butaneamidomethyl group, and a methoxymethyl group.

Preferable examples of the cyan couplers represented by formulae (C-I) and (C-II) are given below:

In formula (C-I), preferably $R^1$ is an aryl group or a heterocyclic group, and more preferably an aryl group substituted by a halogen atom, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group, or a cyano group.

In formula (C-I), when $R^3$ and $R^2$ together do not form a ring, $R^2$ is preferably a substituted or an unsubstituted alkyl group, or an aryl group, and particularly preferably an alkyl group substituted by a substituted aryloxy group, and preferably $R^3$ represents a hydrogen atom.

In formula (C-II), $R^4$ preferably is a substituted or unsubstituted alkyl group or aryl group, and particularly preferably an alkyl group substituted by a substituted aryloxy group.

In formula (C-II), $R^5$ preferably is an alkyl group having 2 to 15 carbon atoms, or a methyl group substituted by a substituent having 1 or more carbon atoms, and the substituent is preferably an arylthio group, an alkylthio group, an acylamino group, an aryloxy group, or an alkyloxy group.

In formula (C-II), $R^5$ preferably is an alkyl group having 2 to 15 carbon atoms, and particularly preferably an alkyl group having 2 to 4 carbon atoms.

In formula (C-II), $R^6$ preferably is a hydrogen atom or a halogen atom, and particularly preferably a chlorine atom or a fluorine atom. In formulae (C-I) and (C-II), $Y_1$ and $Y_2$ each preferably represent a hydrogen atom, a halogen atom, an alkoxy group, an aryloxy group, an acyloxy group, or a sulfonamido group.

In formula (M-I), $R^7$ and $R^9$ each represent an aryl group, $R^8$ represents a hydrogen atom, an aliphatic or aromatic acyl group, an aliphatic or aromatic sulfonyl group, and $Y_3$ represents a hydrogen atom or a coupling split-off group. Allowable substituents of the aryl group represented by $R^7$ and $R^9$ are the same substituents as those acceptable to the substituent $R^1$, and if there are two substituents, they may be the same or different. $R^8$ is preferably a hydrogen atom, an aliphatic acyl group, or a sulfonyl group, and particularly preferably a hydrogen atom. $Y_3$ preferably is of the type that will split-off at one of a sulfur atom, an oxygen atom, and a nitrogen atom, and particularly preferably of the sulfur atom split-off type described, for example, in U.S. Pat. No. 4,351,897 and International Publication Patent No. WO 88/04795.

In formula (Y), $R^{11}$ represents a halogen atom, an alkoxy group, a trifluoromethyl group, or an aryl group, and $R^{12}$ represents a hydrogen atom, a halogen atom, or an alkoxy group. A represents $-NHCOR^{13}$, $$-NHSO_2-\underset{\underset{R^{13}}{|}}{R^{13}},$$

$-SO_2NHR^{13}$, $-COOR^{13}$, or $$-SO_2\underset{\underset{R^{14}}{|}}{N}-R^{13},$$

wherein $R^{13}$ and $R^{14}$ each represent an alkyl group, an aryl group, or an acyl group. $Y_5$ represents a coupling split-off group. Substituents of $R^{12}$, $R^{13}$, and $R^{14}$ are the same as those acceptable to $R^1$, and the coupling split-off group $Y_5$ is of the type that will split off preferably at an oxygen atom or a nitrogen atom, and particularly preferably it is of the nitrogen atom split-off type.

Specific examples of couplers represented by formulae (C-I), (C-II), (M-I), and (Y) are listed below.

(C-1)

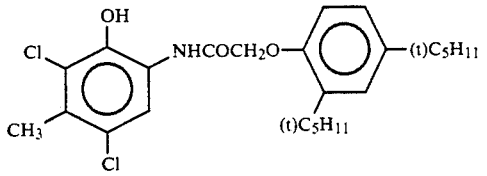

(C-2)

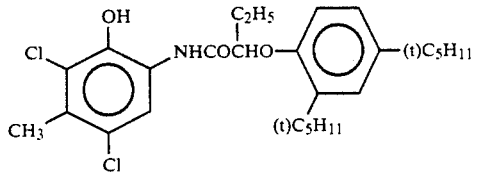

(C-3)

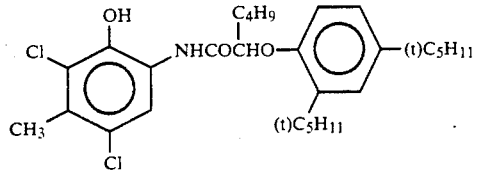

(C-4)

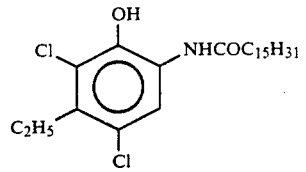

(C-5)

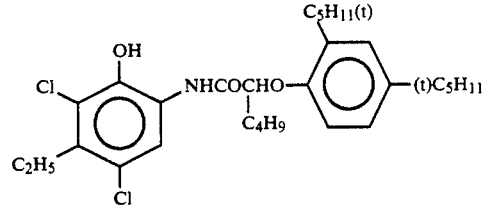

(C-6)

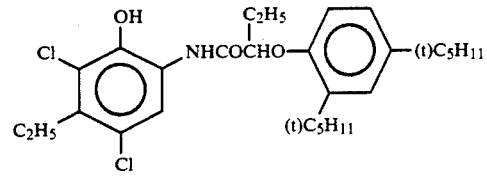

-continued
(C-7)
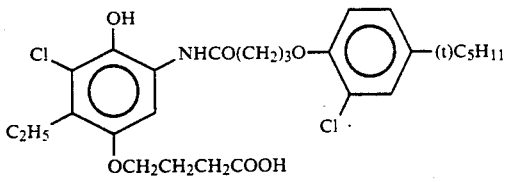
(C-8)
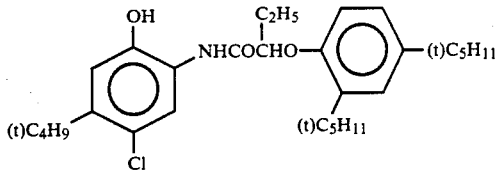
(C-9)
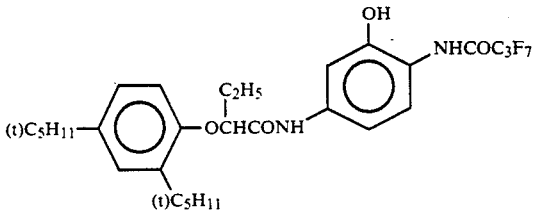
(C-10)
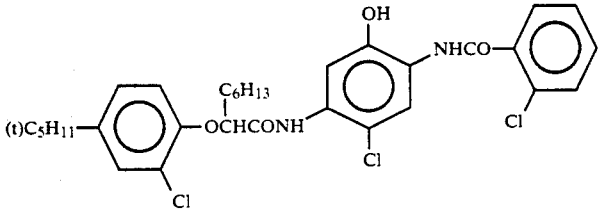
(C-11)
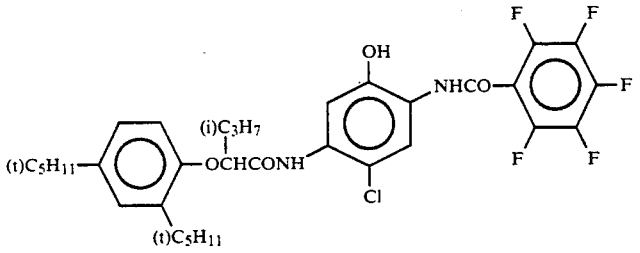
(C-12)
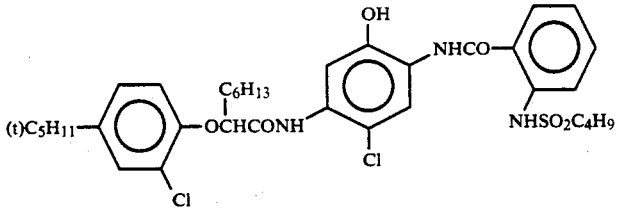
(C-13)
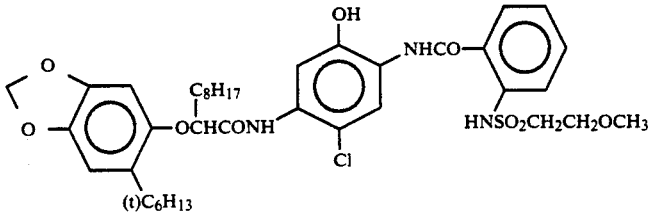

-continued
(C-14)
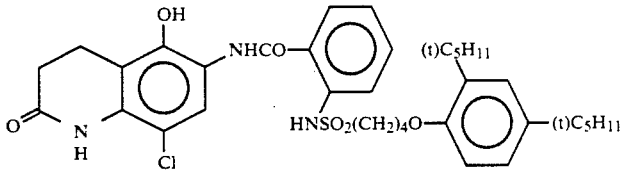
(C-15)
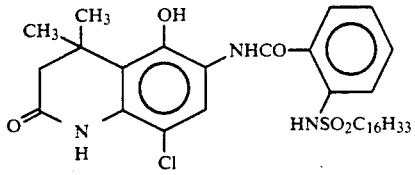
(C-16)
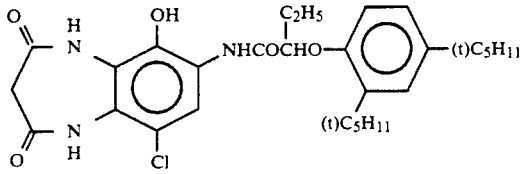
(C-17)
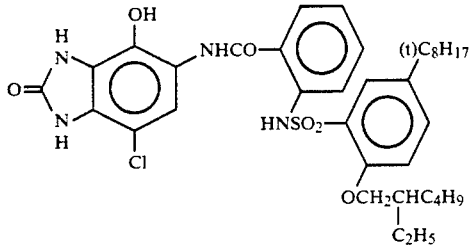
(C-18)
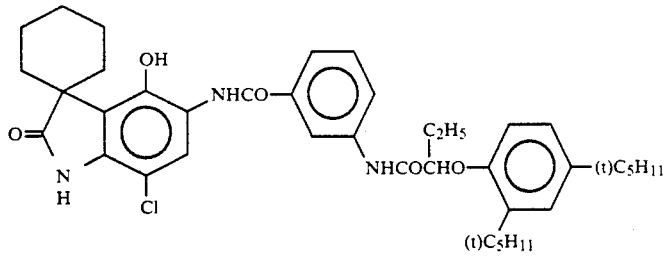
(C-19)
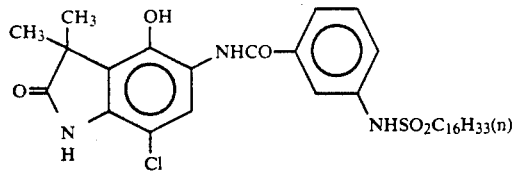
(C-20)
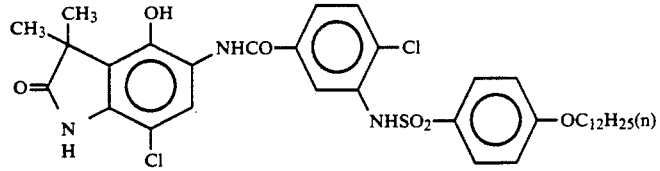
(C-21)
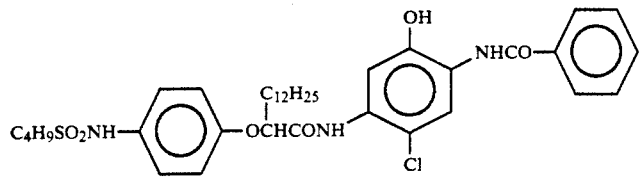

-continued
(C-22)
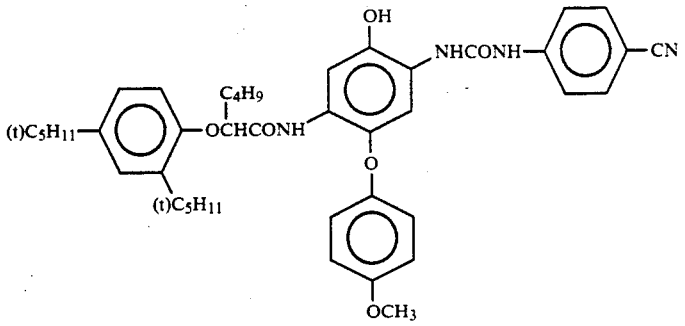
(M-1)
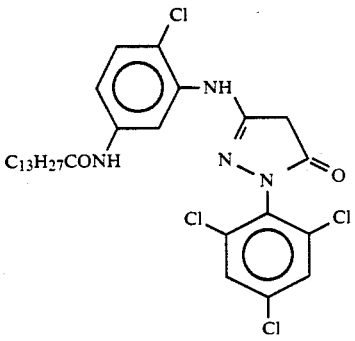
(M-2)
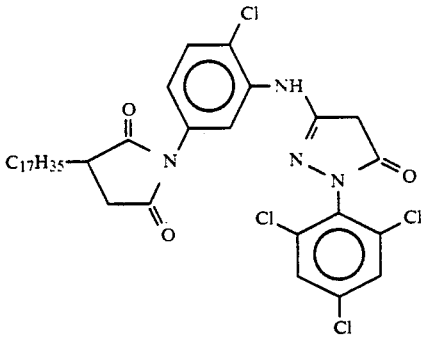
(M-3)
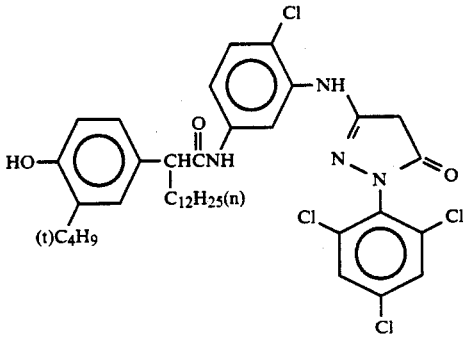

-continued
(M-4)
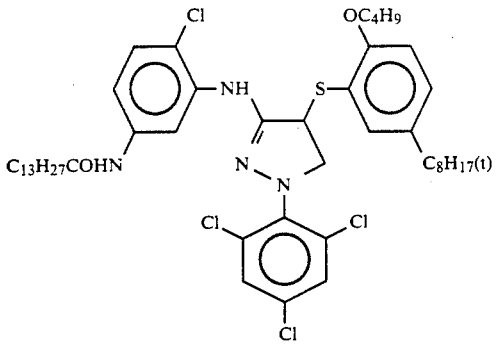
(M-5)
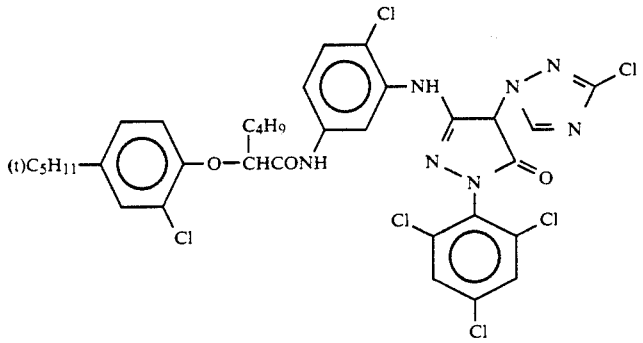
(M-6)
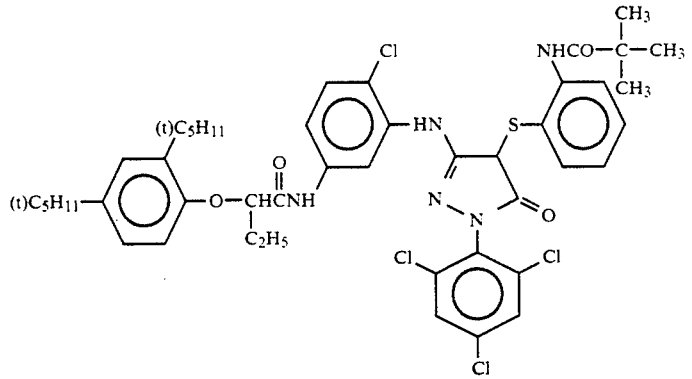
(M-7)
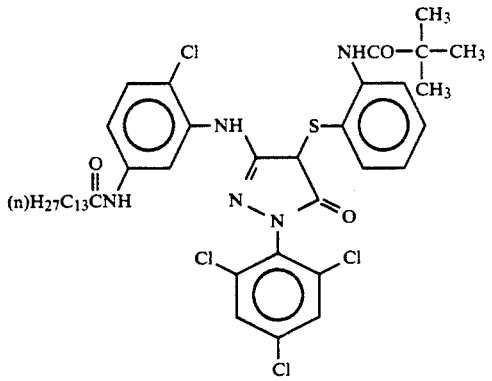

-continued
(M-8)
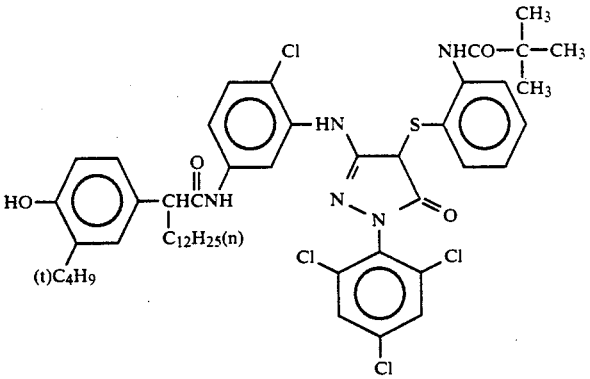
(Y-1)
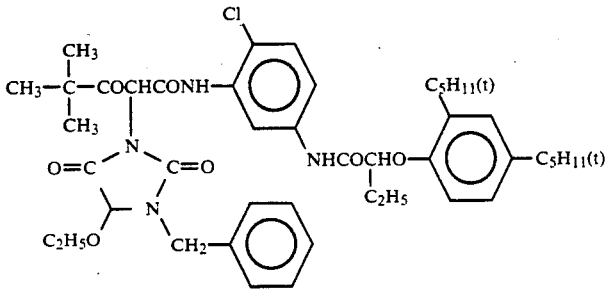
(Y-2)
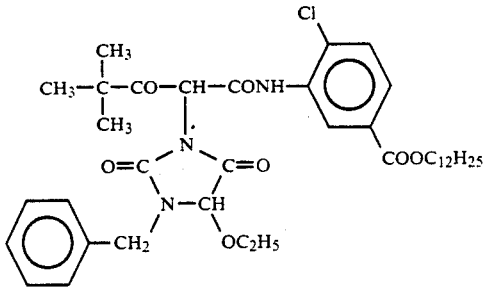
(Y-3)
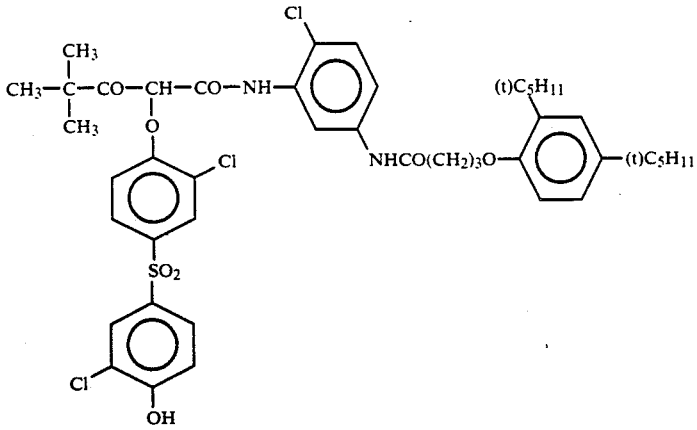
(Y-4)
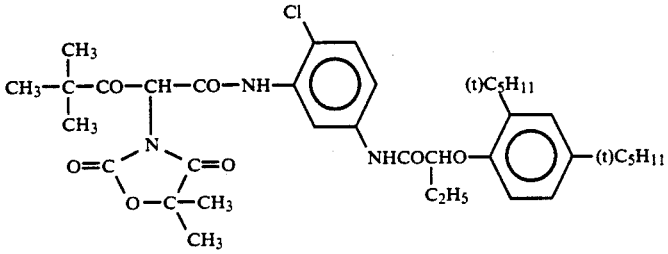

-continued (Y-5)

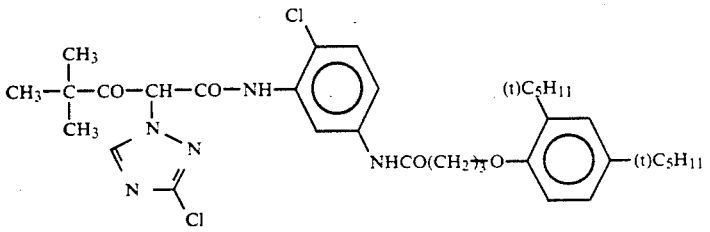

(Y-6)

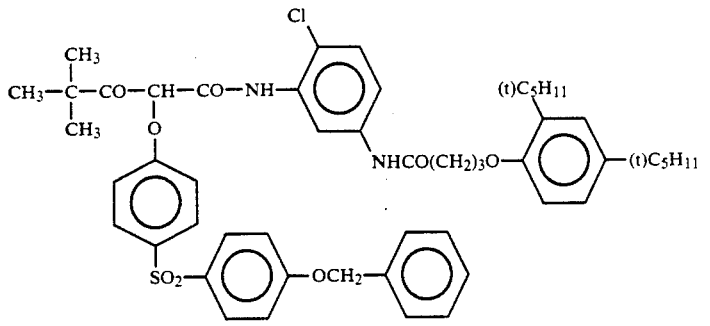

(Y-7)

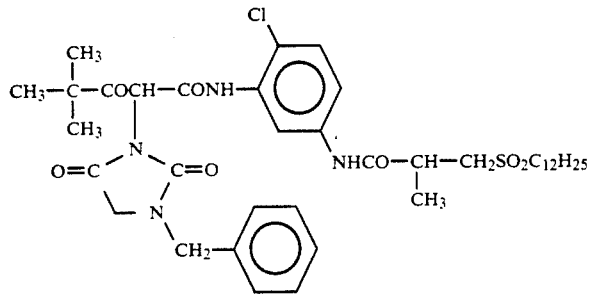

(Y-8)

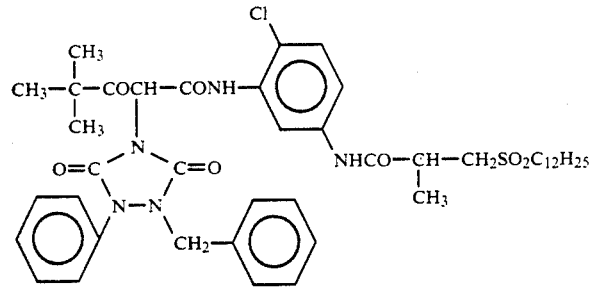

(Y-9)

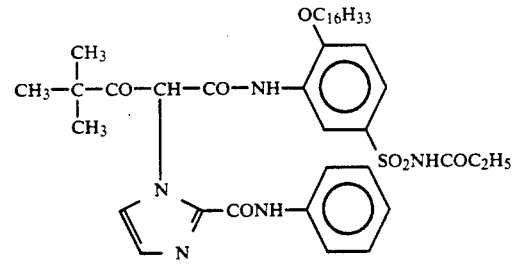

The couplers represented by formulae (C-I) to (Y) are contained in the silver halide emulsion layer constituting the photographic layer generally in an amount of 0.1 to 1.0 mol, preferably 0.1 to 0.5 mol, per mol of the silver halide.

In the present invention, in order to add the coupler to the photographic layer, various known techniques can be applied. Generally, the oil-in-water dispersion method known as the oil-protect method can be used for the addition, that is, after the coupler is dissolved in a solvent, it is emulsified and dispersed into an aqueous gelatin solution containing a surface-active agent. Alternatively, it is also possible that the coupler solution containing a surface-active agent can be added to water or an aqueous gelatin solution to form an oil-in-water dispersion with phase reversal of the emulsion. In the case of an alkali-soluble coupler, it can be dispersed by the so-called Fisher dispersion method. It is also possible that the low-boiling organic solvent can be removed from the coupler dispersion by means of distillation, noodle washing, ultrafiltration, or the like, followed by mixing with the photographic emulsion.

As the dispersion medium for the couplers, it is preferable to use a high-boiling organic solvent and/or a water-insoluble polymer compound having a dielectric constant of 2 to 20 (25° C.) and a refractive index of 1.5 to 1.7 (25° C.).

As the high-boiling organic solvent used in the present invention, any compound other than compounds represented by formulae (III) to (VII) can also be used if the compound has a melting point of 100° C. or below and a boiling point of 140° C. or over, and if the compound is incompatible with water and is a good solvent for the coupler. Preferably the melting point of the high-boiling organic solvent is 80° C. or below. Preferably the boiling point of the high-boiling organic solvent is 160° C. or over, and more preferably 170° C. or over.

Details of these high-boiling organic solvents are described in JP-A No. 215272/1987, page 137 (the right lower column) to page 144 (the right upper column).

The couplers can also be emulsified and dispersed into an aqueous hydrophilic colloid solution by impregnating them into a loadable latex polymer (e.g., U.S. Pat. No. 4,203,716) in the presence or absence of the above-mentioned high-boiling organic solvent, or by dissolving them in a polymer insoluble in water and soluble in organic solvents.

Preferably, homopolymers and copolymers described in International Publication Patent No. WO 88/00723, pages 12 to 30, are used, and particularly the use of acrylamide polymers is preferable because, for example, dye images are stabilized.

The photographic material that is prepared by using the present invention may contain, as color antifoggant, for example, a hydroquinone derivative, an aminophenol derivative, a gallic acid derivative, or an ascorbic acid derivative.

In the photographic material of the present invention, various anti-fading agent (discoloration preventing agent) can be used. That is, as organic anti-fading additives for cyan, magenta and/or yellow images, hydroquinones, 6-hydroxychromans, 6-hydroxycoumarans, spirochromans, p-alkoxyphenols, hindered phenols, including bisphenols, gallic acid derivatives, methylenedioxybenzenes, aminophenols, hindered amines, and ether or ester derivatives obtained by silylating or alkylating the phenolic hydroxyl group of these compounds can be mentioned typically. Metal complexes such as (bissalicylaldoximato)nickel complex and (bis-N,N-dialkyldithiocarbamato)nickel complexes can also be used.

Specific examples of the organic anti-fading agents are described in the following patent specifications:

Hydroquinones are described, for example, in U S. Pat. Nos. 2,360,290, 2,418,613, 2,700,453, 2,701,197, 2,728,659, 2,732,300, 2,735,765, 3,982,944, and 4,430,425, British Patent No. 1,363,921, and U.S. Pat. Nos. 2,710,801 and 2,816,028; 6-hydroxychromans, 5-hydroxycoumarans, and spirochromans are described, for example, in U.S. Pat. Nos. 3,432,300, 3,573,050, 3,574,627, 3,698,909, and 3,764,337 and JP-A No. 152225/1987; spiroindanes are described in U.S. Pat. No. 4,360,589; p-alkoxyphenols are described, for example, in U.S. Pat. No. 2,735,765, British Patent No. 2,066,975, JP-A No. 10539/1984, and JP-B No. 19765/1982; hindered phenols are described, for example, in U.S. Pat. Nos. 3,700,455, JP-A No. 72224/1977, U.S. Pat. No. 4,228,235, and JP-B No. 6623/1977; gallic acid derivatives, methylenedioxybenzenes, and aminophenols are described, for example, in U.S. Patent Nos. 3,457,079 and 4,332,886, and JP-B No. 21144/1981 respectively; hindered amines are described, for example, in U.S. Patent Nos. 3,336,135, 4,268,593, British Patent Nos. 1,326,889, 1,354,313, and 1,410,846, JP-B No. 1420/1976, and JP-A Nos. 114036/1983, 53846/1984, and 78344/1984; and metal complexes are described, for example, in U.S. Pat. Nos. 4,050,938 and 4,241,155 and British Patent 2,027,731(A). To attain the desired purpose compounds can be added to the photosensitive layers by coemulsifying them with the corresponding couplers, with the amount of each compound being generally 5 to 100 wt. % for the particular coupler. To prevent the cyan dye image from being deteriorated by heat, and in particular light, it is more effective to introduce an ultraviolet absorber into the cyan color-forming layer and the opposite layers adjacent to the cyan color-forming layers.

As the ultraviolet absorber, aryl-substituted benzotriazole compounds (e.g., those described in U.S. Pat. No. 3,533,794), 4-thiazolidone compounds (e.g., those described in U.S. Pat. Nos. 3,314,794 and 3,352,681), benzophenone compounds (e.g., those described in JP-A No. 2784/1971), cinnamic acid ester compounds (e.g., those described in U.S. Pat. Nos. 3,705,805 and 3,707,395), butadiene compounds (e.g., those described in U.S. Pat. No. 4,045,229), or benzoxazole compounds (e.g., those described in U.S. Pat. Nos. 3,406,070, 3,677,672, and 4,271,207) can be used. Ultraviolet-absorptive couplers (e.g., α-naphthol type cyan dye forming couplers) and ultraviolet-absorptive polymers can, for example, also be used. These ultraviolet-absorbers may be mordanted in a particular layer.

In particular, the above-mentioned aryl-substituted benzotriazole compounds are preferable.

In the present invention, together with the above couplers, in particular together with the pyrazoloazole coupler, the following compounds are preferably used.

That is, it is preferred that a compound (F), which will chemically bond to the aromatic amide developing agent remaining after the color-developing process, to form a chemically inactive and substantially colorless compound, and/or a compound (G), which will chemically bond to the oxidized product of the aromatic amide color developing agent remaining after the color-developing process, to form a chemically inactive and substantially colorless compound, are used simultaneously or separately, for example, to prevent the occurrence of stain due to the formation of a color-developed dye by the reaction of the couplers with the color-developing agent remaining in the film during storage after the processing or with the oxidized product of the color-developing agent, and to prevent other side effects.

Preferable as compound (F) are those that can react with p-anisidine having a second-order reaction-specific rate k2 (in trioctyl phosphate at 80° C.) in the range of 1.0 l/mol·sec to $1\times10^{-5}$ l/mol·sec. The second-order reaction- specific rate can be determined by the method described in JP-A No. 158545/1983.

If k2 is over this range, the compound itself becomes unstable, and in some cases the compound reacts with gelatin or water to decompose. On the other hand, if $k_2$ is below this range, the reaction with the remaining aromatic amine developing agent becomes slow, resulting, in some cases, in the failure to prevent the side effects of the remaining aromatic amine developing agent, which prevention is aimed at by the present invention.

More preferable as compound (F) are those that can be represented by the following formula (FI) or (FII):

$$R_{31}-(A)_n-X_{31} \quad \text{Formula (FI)}$$

$$R_{32}-\underset{\underset{B}{|}}{C}=Y_{32} \quad \text{Formula (FII)}$$

wherein $R_{31}$ and $R_{32}$ each represent an aliphatic group, an aromatic group, or a heterocyclic group, n is 1 or 0, A represents a group that will react with an aromatic amine developing agent to form a chemical bond therewith, $X_{31}$ represents a group that will react with the aromatic amine developing agent and split off, B represents a hydrogen atom, an aliphatic group, an aromatic group, a heterocyclic group, an acyl group, or a sulfonyl group, Y represents a group that will facilitate the addition of the aromatic amine developing agent to the compound represented by formula (FII), and $R_{31}$ and $X_{31}$, or $Y_{32}$ and $R_{32}$ or B, may bond together to form a ring structure.

Of the processes wherein compound (F) bonds chemically to the remaining aromatic amine developing agent, typical processes are a substitution reaction and an addition reaction.

Specific examples of the compounds represented by formulae (FI), and (FII) are described, for example, in JP-A Nos. 158545/1988, 28338/1987, 2042/1989, and 86139/1989.

On the other hand, more preferable examples of compound (G), which will chemically bond to the oxidized product of the aromatic amine developing agent remaining after color development processing, to form a chemically inactive and colorless compound, can be represented by the following formula (GI):

$$R_{33}-Z_{33} \quad \text{Formula (GI)}$$

wherein $R_{33}$ represents an aliphatic group, an aromatic group, or a heterocyclic group, $Z_{33}$ represents a nucleophilic group or a group that will decompose in the photographic material to release a nucleophilic group. Preferably the compounds represented by formula (GI) are ones wherein Z represents a group whose Pearson's nucleophilic $^{n}CH_3I$ value (R. G. Pearson, et al., *J. Am. Chem. Soc.*, 90, 319 (1968)) is 5 or over, or a group derived therefrom.

Specific examples of compounds represented by formula (GI) are described, for example, in European Published Patent No. 255722, JP-A Nos. 143048/1987, 229145/1987, 230039/1989, and 57259/1989, and European Published Patent Nos. 298321 and 277589.

Details of combinations of compound (G) and compound (F) are described in European Published Patent No. 277589.

The photographic material prepared in accordance with the present invention may contain, in the hydrophilic colloid layer, water-soluble dyes as filter dyes or to prevent irradiation, and for other purposes. Such dyes include oxonol dyes, hemioxonol dyes, styryl dyes, merocyanine dyes, cyanine dyes, and azo dyes. Among others, oxonol dyes, hemioxonol dyes, and merocyanine dyes are useful.

As a binder or a protective colloid that can be used in the emulsion layers of the present photographic material, gelatin is advantageously used, but other hydrophilic colloids can be used alone or in combination with gelatin.

In the present invention, gelatin may be lime-treated gelatin or acid-processed gelatin. Details of the manufacture of gelatin is described by Arthur Veis in *The Macromolecular Chemistry of Gelatin* (published by Academic Press, 1964).

As a base to be used in the present invention, a transparent film, such as cellulose nitrate film, and polyethylene terephthalate film or a reflection-type base that is generally used in photographic materials can be used. The use of a reflection-type base is more preferable for the purpose of the present invention.

The "reflection base" is one that enhances reflectivity, thereby making sharper the dye image formed in the silver halide emulsion layer, and it includes one having a base coated with a hydrophobic resin containing a dispersed light- reflective substance, such as titanium oxide, zinc oxide, calcium carbonate, and calcium sulfate, and also a base made of a hydrophobic resin containing a dispersed light- reflective substance. For example, there can be mentioned baryta paper, polyethylene-coated paper, polypropylene- type synthetic paper, a transparent base having a reflective layer, or additionally using a reflective substance, such as glass plate, polyester films of polyethylene terephthalate, cellulose triacetate, or cellulose nitrate, polyamide film, polycarbonate film, polystyrene film, and vinyl chloride resin.

As the other reflection base, a base having a metal surface of mirror reflection or secondary diffuse reflection may be used. A metal surface having a spectral reflectance in the visible wavelength region of 0.5 or more is preferable and the surface is preferably made to show diffuse reflection by roughening the surface or by using a metal powder. The surface may be a metal plate, metal foil or metal thin layer obtained by rolling, vapor deposition or galvanizing of metal such as, for example, aluminum, tin, silver, magnesium and alloy thereof. Of these, a base obtained by vapor deposition of metal is preferable. It is preferable to provide a layer of water resistant resin, in particular, a layer of thermoplastic resin. The opposite side to metal surface side of the base according to the present invention is preferably provided with an antistatic layer. The details of such base are described, for example, in JP-A Nos. 210346/1986, 24247/1988, 24251/1988 and 24255/1988.

It is advantageous that, as the light-reflective substance, a white pigment is kneaded well in the presence of a surface-active agent, and it is preferable that the surface of the pigment particles has been treated with a divalent to tetravalent alcohol.

The occupied area ratio (%) per unit area prescribed for the white pigments finely divided particles can be obtained most typically by dividing the observed area into contiguous unit areas of 6 $\mu m \times 6$ $\mu m$, and measuring the occupied area ratio (%) (Ri) of the finely divided particles projected onto the unit areas. The deviation coefficient of the occupied area ratio (%) can be obtained based on the ratio $s/\overline{R}$, wherein s stands for the standard deviation of Ri, and $\overline{R}$ stands for the average value of Ri. Preferably, the number (n) of the unit areas to be subjected is 6 or over. Therefore, the deviation coefficient $s/\overline{R}$ can be obtained by $$\sqrt{\frac{\sum_{i=1}^{n}(R_i-\bar{R})^2}{n-1}} \Big/ \frac{\sum_{i=1}^{n} R_i}{n}$$

In the present invention, preferably the deviation coefficient of the occupied area ratio (%) of the finely divided particles of a pigment is 0.15 or below, and particularly 0.12 or below. If the variation coefficient is 0.08 or below, it can be considered that the substantial dispersibility of the particles is substantially "uniform."

Preferably, the color developer used for the development processing of the photographic material of the present invention is an aqueous alkaline solution whose major component is an aromatic primary amine color-developing agent. As the color-developing agent, aminophenol compounds are useful, though p-phenylene diamine compounds are preferably used, and typical examples thereof include 3-methyl-4-amino-N,N-hydroxyethylaniline, 3-methyl-4-amino-N-ethyl-N-β-hydroxyethylaniline, 3-methyl-4-amino-N-ethyl-N-β-methanesulfonamidoethylaniline, and 3-methyl-4-amino-N-ethyl-N-β-methoxyethylaniline, and their sulfates, hydrochlorides, and p-toluenesulfonates. A combination of two or more of these compounds may be used in accordance with the purpose.

The color developer generally contains, for example, buffers, such as carbonates or phosphates of alkali metals, and development inhibitors or antifoggants, such as bromide salts, iodide salts, benzimidazoles, benzothiazoles, or mercapto compounds. The color developer may, if necessary, contain various preservatives, such as hydroxylamine, diethylhydroxylamine, sulfites, hydrazines for example N,N-biscarboxymethylhydrazine, phenylsemicarbazides, triethanolamine, and catecholsulfonic acids, organic solvents such as ethylene glycol and diethylene glycol, development accelerators such as benzyl alcohol, polyethylene glycol, quaternary ammonium salts, and amines, dye forming couplers, competing couplers, auxiliary developers such as 1-phenyl-3-pyrazolidone, tackifiers, and various chelate agents as represented by aminopolycarboxylic acids, aminopolyphosphonic acids, alkylphosphonic acids, and phosphonocarboxylic acids, typical example thereof being ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, and ethylenediamine-di(o-hydroxyphenylacetic acid), and their salts.

If reversal processing is carried out, it is common that after black and white development and reversal processing are carried out, the color development is carried out. As the black and white developers, known black and white developing agents, such as dihydroxybenzenes, for example hydroquinone, 3-pyrazolidones, for example 1-phenyl-3-pyrazolidone, and aminophenols, for example N-methyl-p-aminophenol, can be used alone or in combination.

Generally the pH of this color developer and black-and-white developing solution is 9 to 12. The replenishing amount of these developing solutions is generally 3 l or below per square meter of the color photographic material to be processed, though the replenishing amount changes depending on the type of color photographic material, and if the concentration of bromide ions in the replenishing solution is lowered previously, the replenishing amount can be lowered to 500 ml or below per square meter of the color photographic material. If it is intended to lower the replenishing amount, it is preferable to prevent the evaporation of the solution and oxidation of the solution with air by reducing the area of the solution in the processing tank that is in contact with the air. The contact area of the photographic processing solution with the air in the processing tank is represented by the open surface ratio which is defined as follows:

$$\text{Open surface ratio } (\text{cm}^{-1}) = \frac{\text{Contact surface area } (\text{cm}^2) \text{ of the processing solution with the air}}{\text{Whole volume } (\text{cm}^3) \text{ of the processing solution}}$$

wherein "contact surface area of the processing solution with the air" means a surface area of the processing solution that is not covered by anything such as floating lids or rolls.

The open surface ratio is preferably 0.1 $cm^{-1}$ or less, more preferably 0.001 to 0.05 $cm^{-1}$.

Methods for reducing the open surface ratio that can be mentioned include the utilization of movable lids as described in JP-A NO. 241342/1987 and a slit-developing process as described in JP-A No. 216050/1988, besides a method of providing a shutting materials such as floating lids.

It is preferable to adopt the means for reducing the open surface ratio not only in a color developing and black-and-white developing process but also in all succeeding processes, such as bleaching, bleach-fixing, fixing, washing, and stabilizing process.

It is also possible to reduce the replenishing amount by using means of suppressing the accumulation of bromide ions in the developer.

Although the processing time of color developing is settled, generally, between 2 and 5 minutes, the time can be shortened by, for example, processing at high temperature and at high pH, and using a color developer having a high concentration of color developing agent.

The photographic emulsion layer are generally subjected to a bleaching process after color development.

The beaching process can be carried out together with the fixing process (bleach-fixing process), or it can be carried out separately from the fixing process. Further, to quicken the process bleach-fixing may be carried out after the bleaching process. In accordance with the purpose, the process may be arbitrarily carried out using a bleach-fixing bath having two successive tanks, or a fixing process may be carried out before the bleach-fixing process, or a bleaching process. As the bleaching agent, use can be made of, for example, compounds of polyvalent metals, such as iron (III). As a typical bleaching agent, use can be made of organic complex salts of iron (III), such as complex salts of aminopolycarboxylic acids, for example ethylenediaminetetraacetic acid, diethylenetriaminetetraacetic acid, cyclohexanediaminetetraacetic acid, methyliminodiacetic acid, 1,3-diaminopropanetetraacetic acid, and glycoletherdiaminetetraacetic acid, citric acie, tartaric acid, and malic acid. Of these, aminopolycarboxylic acid iron (III) complex salts, including ethylenediaminetetraacetic acid iron (III) complex salts are preferable in view of rapid-processing and the prevention of pollution. Further, aminopolycarboxylic acid iron (III) complex salts are particularly useful in a bleaching solution as well as a bleach-fixing solution. The pH of the bleaching solution or the bleach-fixing solution using these aminopolycarboxylic acid iron (III) complex salts is generally 4.0 to 8.0, but if it is required to quicken the process, the process can be effected at a low pH.

In the bleaching solution, the bleach-fixing solution, and the bath preceding them a bleach-accelerating agent may be used if necessary. Examples of useful bleach-accelerating agents are compounds having a mercapto group or a disulfide linkage, described in JA-A Patent No. 95630/1978, and *Research Disclosure* No. 17129 (July, 1978); thiazolidine derivatives, described in JP-A No. 140129/1975; thiourea derivatives, described in U.S. Pat. No. 3,706,561; iodide salts, described in JP-A No. 16235/1983; polyoxyethylene compounds in West German Patent No. 2,748,460; polyamine compounds, described in JP-B No. 8836/1970; and bromide ions. Of these, compounds having a mercapto group or a disulfide group are preferable in view of higher acceleration effect, and in particular, compounds described in U.S. Pat. No. 3,893,858, West German Patent No. 1,290,812, and JP-A No. 95630/1978 are preferable. Compound described in U.S. Pat. No. 4,552,834 are preferable. These bleach-accelerating agents may be added into a photographic material. When the color photographic materials for photographing are to be bleach-fixed, these bleach-accelerating agents are particularly effective.

As a fixing agent can be mentioned thiosulfates, thiocyanates, thioether-type compounds, thioureas, and large amounts of iodide salts, although thiosulfate is used usually, and in particular ammonium thiosulfate is widely used. As the preservative for bleach-fix solution sulfite salt, bisulfite salt, or carbonyl-bisulfite adduct is preferably.

It is common for the silver halide color photographic material of the present invention to undergo, after a desilvering process such as fixing or bleach-fix, a washing step and/or a stabilizing step. The amount of washing water may be set within a wide range depending on the characteristics (e.g., due to the materials used, such as couplers), the application of the photographic material, the washing temperature, the number of washing tanks (the number if steps), the type of replenishing system, including, for example, the counter-current system and the direct flow system and other various conditions. Of these, the relationship between the number of water-washing tanks and the amount of washing water in the multi-stage counter current system can be found according to the method described in *Journal of Society of Motion Picture and Television Engineers,* Vol. 64, pages 248 to 253 (May 1955).

According to the multi-stage-counter-current system described in the literature mentioned above, although the amount of washing water can be considerably reduced, bacteria propagate with an increase of retention time of the washing water in the tanks, leading to a problem with the resulting suspended matter adhering to the photographic material. In processing the present color photographic material, as a measure to solve this problem the method of reducing calcium and magnesium described in JP-A No. 288838/1987 can be used quite effectively. Also chlorine-type bactericides such as sodium chlorinated isocyanurate, cyabendazoles, isothiazolone compounds described in JP-A No. 8542/1982, benzotriazoles, and other bactericides described by Hiroshi Horiguchi in *Bokin Bobai-zai no Kaqaku,* (1986) published by Sankyo-Shuppan, *Biseibutsu no mekkin, Sakkin, Bobaigijutsu* (1982) edited by Eiseigijutsu-kai, published by Kogyo-Gijutsu-kai, and in *Bokin Bobaizai Jiten* (1986) edited by Nihon Bokin Bobai-gakkai, can be used.

The pH of the washing water used in processing the present photographic material is 4 to 9, preferably 5 to 8. The washing water temperature and the washing time to be set may very depending, for example, on the characteristics and the application of the photographic material, and they are generally selected in the range of 15° to 45° C. for 20 sec to 10 min, and preferably in the range of 25° to 40° C. for 30 sec to 5 min. Further, the photographic material of the present .invention can be processed directly with a stabilizing solution instead of the above washing. In such a stabilizing process, any of known processes, for example, a multi-step counter-current stabilizing process or its low-replenishing-amount process, described in JP-A Nos. 8543/1982, 14834/1983, and 220345/1985.

In some cases, the above washing process is further followed by a stabilizing process, and as an example thereof can be mentioned a stabilizing bath that is used as a final bath for color photographic materials for photography, which contains formalin and a surface-active agent. In this stabilizing bath, each kind of the chelating agents and bactericides may be added.

The over-flow solution due to the replenishing of washing solution and/or stabilizing solution may be reused in other steps, such as a desilvering step.

The silver halide color photographic material of the present invention may contain therein a color-developing agent for the purpose of simplifying and quickening the process. To contain such a color-developing agent, it is preferable to use a precursor for the color-developing agent. For example, indoaniline-type compounds described in U.S. Pat. No. 3,342,597, Schiff base-type compounds described in U.S. Pat. No. 3,342,599 and *Research Disclosure* Nos. 14850 and 15159, aldol compounds described in *Research Disclosure* No. 13924, and metal salt complexes described in U.S. Pat. No. 3,719,492, and urethane-type compounds described in JP-A No. 135628/1978 can be mentioned.

For the purpose of accelerating the color development, the present silver halide color photographic material may contain, if necessary, various 1-phenyl-3-pyrazolicones. Typical compounds are described in JP-A Nos. 64339/1981, 144547/1982, and 115438/1983.

The various processing solutions used for the present invention may be used at 10° to 50° C. Although generally a temperature of 33° to 38° C. may be standard, a higher temperature can be used to accelerate the process to reduce the processing time, or a lower temperature can be used to improve the image quality or the stability of the processing solution. Also, to save the silver of the photographic material, a process using hydrogen peroxide intensification or cobalt intensification described in West German Patent No. 2,226,770 and U.S. Pat. No. 3,674,499 may be carried out.

When compounds of the present invention are used, color images less in subsidiary absorption, good in color reproduction, and excellent in fastness can be obtained.

As is apparent from the Synthesis Examples, compounds of the present invention can be synthesized from inexpensive raw materials in four steps, which is a small number and advantageous in view of the cost.

The present silver halide color photographic material can give a color photograph wherein the color reproduction quality is excellent and the light-fastness of the dye image is remarkably improved from the high-density part to the low-density part. Further, the present silver halide color photographic material is excellent in process stability, that is, for example, if it is processed with a color developer into which a bleaching solution or a bleach-fix solution has accidentally been mixed, the change in the maximum color density is low, which means that the stability is excellent.

Next, the present invention will be described in detail in accordance with examples, but the invention is not limited to these Examples.

EXAMPLE 1

A multilayer photographic material was prepared by multi-coatings composed of the following layer composition on a two-side polyethylene laminated paper support. Coating solutions were prepared as follows:

Preparation of the first layer coating solution

To a mixture of 19.1 g of yellow coupler (ExY), 4.4 g of image-dye stabilizer (Cpd-1) and 1.8 g of image-dye stabilizer (Cpd-6), 27.2 ml of ethyl acetate and each 4.1 g of solvents (Solv-2) and (Solv-5) were added and dissolved. The resulting solution was dispersed and emulsified in 185 ml of 10% aqueous gelatin solution containing 8 ml of sodium dodecylbenzenesulfonate. Separately another emulsion was prepared by adding a blue-sensitive sensitizing dye, shown below, to a blend of silver chlorobromide emulsions (mixture in silver molar ratio of 1:3 of two respectively having 0.88 μm and 0.7 μm of average grain size, and 0.08 and 0.10 of deviation coefficient of grain size distribution) in such amounts that the sensitizing dye corresponds $5.0\times10^{-4}$ mol per mol of silver, and then sulfur-sensitized. The thus-prepared emulsion and the above-obtained emulsified dispersion were mixed together and dissolved to give the composition shown below, thereby preparing the first layer coating solution.

Coating solutions for the second to seventh layers were also prepared in the same manner as the first-layer coating solution. As a gelatin hardener for the respective layers, 1-hydroxy-3,5-dichloro-s-treazine sodium salt was used.

As spectral-sensitizing dyes for the respective layers, the following compounds were used:

Blue-sensitive emulsion layer:

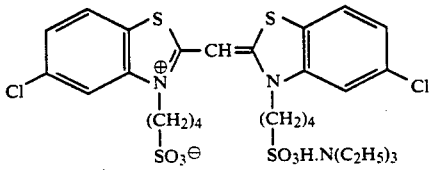

($5.0\times10^{-4}$ mol per mol of silver halide)

Green-sensitive emulsion layer:

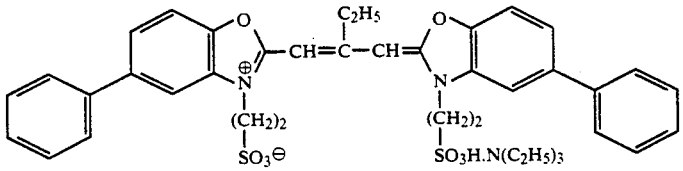

($4.0\times10^{-4}$ mol per mol of silver halide)

and

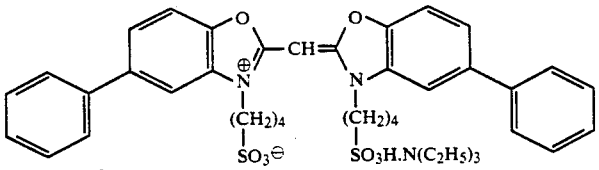

($7.0\times10^{-5}$ mol per mol of silver halide)

Red-sensitive emulsion layer:

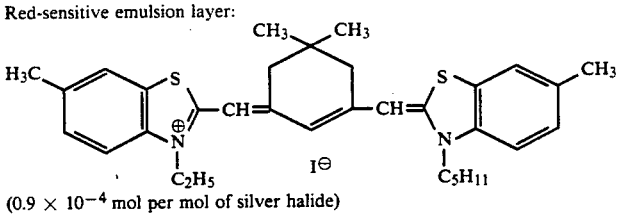

($0.9\times10^{-4}$ mol per mol of silver halide)

To the red-sensitive emulsion layer, the following compound was added in an amount of $2.6\times10^{-3}$ mol per mol of silver halide:

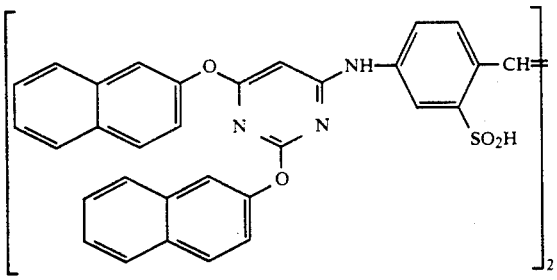

Further, to the blue-sensitive emulsion layer, the green-sensitive emulsion layer, and the red-sensitive emulsion layer, 1-(5-methylureidophenyl)-5-mercaptotetrazole was added in amounts of $4.0\times10^{-6}$ mol, $3.0\times10^{-5}$ mol, and $1.0\times10^{-5}$ mol per mol of silver halide, respectively, and 2-methyl-5-t-octylhydroquinone was added in amounts of $8\times10^{-3}$ mol, $2\times10^{-2}$ mol, and $2\times10^{-2}$ mol per mol of silver halide, respectively.

Further, to the blue-sensitive emulsion layer and the green-sensitive layer 4-hydroxy-6-methyl-1,3,3a,7-tetrazaindene was added in amounts of $1.2\times10^{-2}$ mol and $1.1\times10^{-2}$ mol per mol of silver halide, respectively.

Further, to the red-sensitive emulsion layer mercaptoimidazole shown below in an amount of $1\times10^{-4}$ mol per mol of silver halide and mercaptothiadiazole shown below in an amount of $4\times10^{-4}$ mol per mol of silver halide were added.

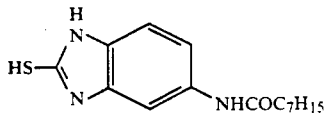

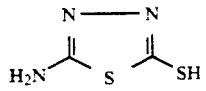

The following dyes were added to the emulsion layers to prevent irradiation.

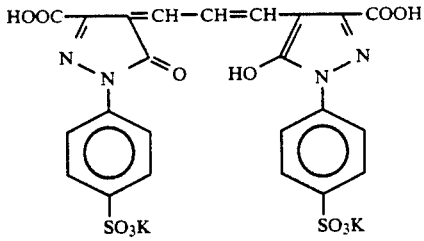

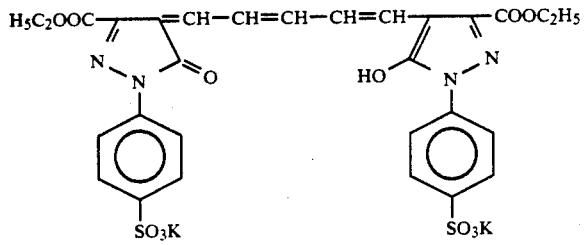

Composition of Layers

The composition of each layer is shown below. The figures represent coating amount (g/m$^2$). The coating amount of each silver halide emulsion is given in terms of silver.

Supporting Base

Paper laminated on both sides with polyethylene (a white pigment, $TiO_2$, and a bluish dye, ultramarine, were included in the first layer side of the polyethylene-laminated film)

| | |
|---|---|
| First Layer (Blue-sensitive emulsion layer): | |
| The above-described silver chlorobromide emulsion (AgBr: 80 mol %) | 0.26 |
| Gelatin | 1.83 |
| Yellow coupler (ExY) | 0.83 |
| Image-dye stabilizer (Cpd-1) | 0.19 |
| Image-dye stabilizer (Cpd-6) | 0.08 |
| Solvent (Solv-2) | 0.18 |
| Solvent (Solv-5) | 0.18 |
| Second Layer (Color-mix preventing layer): | |
| Gelatin | 0.99 |
| Color mix inhibitor (Cpd-4) | 0.08 |
| Solvent (Solv-1) | 0.16 |
| Solvent (Solv-3) | 0.08 |
| Third Layer (Green-sensitive emulsion layer): | |
| Silver chlorobromide emulsions (cubic grains, 1:1 (Ag mol ratio) blend of grains having 0.47 μm and 0.36 μm of average grain size, and 0.12 and 0.09 of deviation coefficient of grain size distribution, respectively, each having 90 mol % of AgBr) | 0.16 |
| Gelatin | 1.79 |
| Magenta coupler (ExM) | see Table 1 |
| Image-dye stabilizer (Cpd-2) | 0.20 |
| Image-dye stabilizer (Cpd-3) | 0.01 |
| Image-dye stabilizer (Cpd-7) | 0.03 |
| Image-dye stabilizer (Cpd-8) | 0.04 |
| Solvent | see Table 1 |
| Fourth Layer (Ultraviolet absorbing layer): | |
| Gelatin | 1.58 |
| Ultraviolet absorber (UV-1) | 0.47 |
| Color-mix inhibitor (Cpd-4) | 0.05 |
| Solvent (Solv-5) | 0.24 |
| Fifth Layer (Red-sensitive emulsion layer): | |
| Silver chlorobromide emulsions (cubic grains, 1:4 (Ag mol ratio) blend of grains having 0.49 μm and 0.34 μm of average grain size, and 0.08 and 0.10 of deviation coefficient of grain size distribution, respectively, | 0.23 |

-continued

| | |
|---|---|
| each having 90 mol % of AgBr) | |
| Gelatin | 1.34 |
| Cyan coupler (ExC) | 0.30 |
| Image-dye stabilizer (Cpd-5) | 0.17 |
| Image-dye stabilizer (Cpd-6) | 0.40 |
| Solvent (Solv-5) | 0.20 |
| Sixth layer (Ultraviolet ray absorbing layer): | |
| Gelatin | 0.53 |
| Ultraviolet absorber (UV-1) | 0.16 |

-continued

| | |
|---|---|
| Color-mix inhibitor (Cpd-4) | 0.02 |
| Solvent (Solv-4) | 0.08 |
| Seventh layer (Protective layer): | |
| Gelatin | 1.33 |
| Acryl-modified copolymer of polyvinyl alcohol (modification degree : 17%) | 0.17 |
| Liquid paraffin | 0.03 |

Compounds used are as follows:

(Cpd-1) Image-dye stabilizer

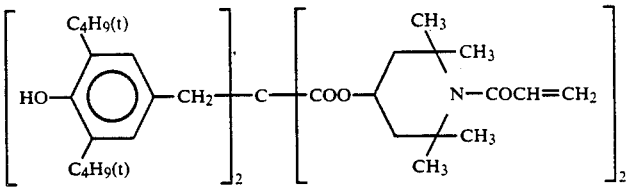

(Cpd-2) Image-dye stabilizer

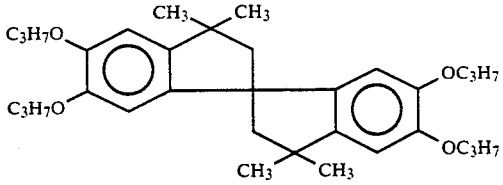

(Cpd-3) Image-dye stabilizer

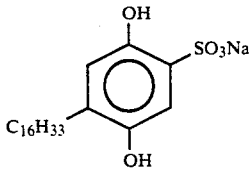

(Cpd-4) Color-mix inhibitor

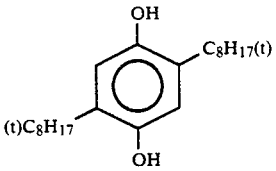

(Cpd-5) Image-dye stabilizer

Mixture (2:4:4 in weight ratio) of

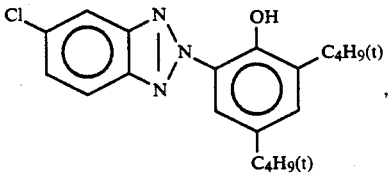

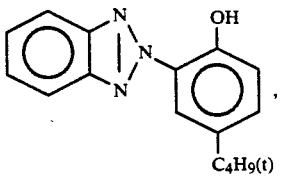

and

-continued
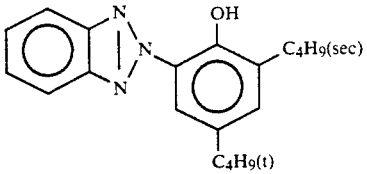
(Cpd-6) Image-dye stabilizer
$$\left(CH_2-\underset{\substack{|\\ CONHC_4H_9(t)}}{CH}\right)_n$$
Average molecular weight: 80,000
(Cpd-7) Image-dye stabilizer
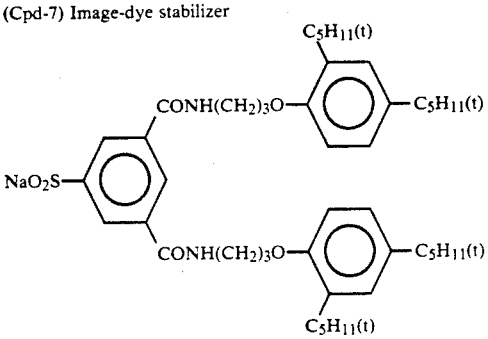
(Cpd-8) Image-dye stabilizer
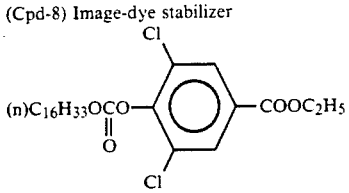
(UV-1) Ultraviolet ray absorber
Mixture (4:2:4 in weight ratio) of
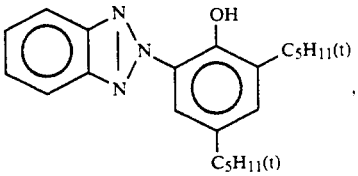
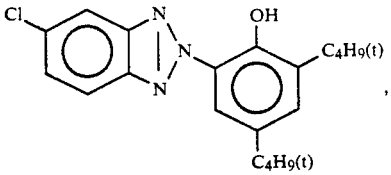
and
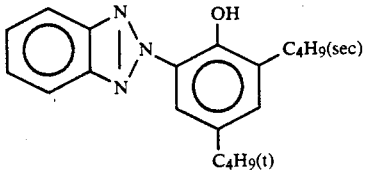
(Solv-1) Solvent
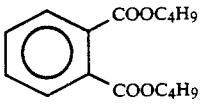

-continued (Solv-2) Solvent
$O{=}P{+}O{-}C_9H_{19}(iso)]_3$ (Solv-3) Solvent

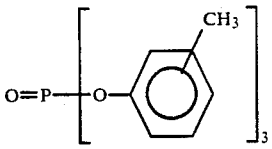

(Solv-4) Solvent
$COOC_8H_{17}$
|
$(CH_2)_8$
|
$COOC_8H_{17}$ (Solv-5) Solvent
$C_8H_{17}CHCH(CH_2)_7COOC_8H_{17}$
\ /
O (ExY) Yellow coupler
Mixture (1:1 in molar ratio) of

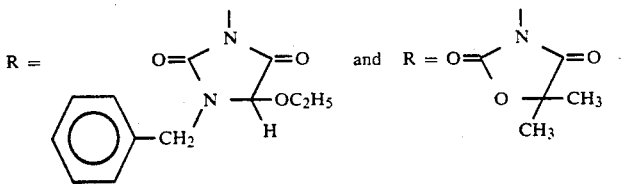

of the following formula

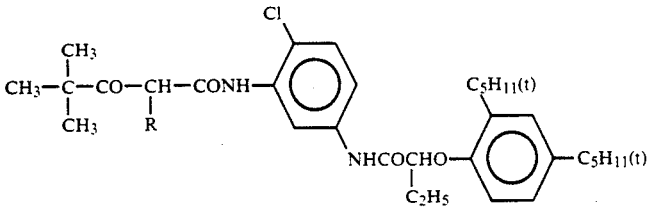

(ExC) Cyan coupler
Mixture (1:1 in molar ratio) of

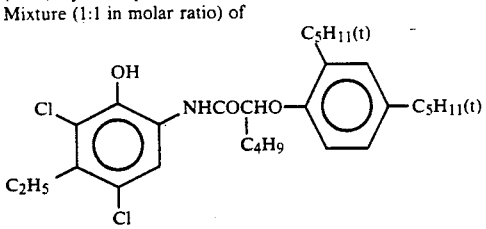

and

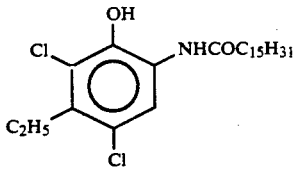

Each of samples above described was subjected to a gradation exposure to light through three color separated filters for sensitometry using a sensitometer (FWH model by Fuji Photo Film Co., Ltd., the color temperature of light source was 3200 K). At that time, the exposure was carried out in such a manner that the exposure was 250 CMS with the exposure time being 0.1 second.

After exposure to light, each sample was subjected to the processing process in accordance with processing process (A).

| Processing process (A) | | |
|---|---|---|
| Processing step | Temperature | Time |
| Color developing | 37° C. | 3 min. 30 sec. |
| Bleach-fixing | 33° C. | 1 min. 30 sec. |

-continued

| Processing step | Processing process (A) Temperature | Time |
|---|---|---|
| Water-washing | 24–34° C. | 3 min. |
| Drying | 70–80° C. | 1 min. |

The compositions of each processing solution were as follows:

| Color developer | |
|---|---|
| Water | 800 ml |
| Diethylenetriaminepentaacetic acid | 1.0 g |
| Nitrilotriacetic acid | 2.0 g |
| Benzyl alcohol | 15 ml |
| Diethylene glycol | 10 ml |
| Sodium sulfite | 2.0 g |
| Potassium bromide | 1.0 g |
| Potassium carbonate | 30 g |
| N-ethyl-N-(β-methanesulfonamidoethyl)-3-methyl-4-aminoaniline sulfate | 4.5 g |
| Hydroxylamine sulfate | 3.0 g |
| Fluorescent brightening agent (WHITEX-4, made by Sumitomo Chem. Ind. Co., Ltd.) | 1.0 g |
| Water to make | 1000 ml |
| pH (25° C.) | 10.25 |
| Bleach-fixing solution | |
| Distilled water | 400 ml |
| Ammonium thiosulfate (70%) | 150 ml |
| Sodium sulfite | 18 g |
| Iron (III) ammonium ethylenediamine-tetraacetate | 55 g |
| Disodium ethylenediaminetetraacetate | 5 g |
| Water to make | 1000 ml |
| pH (25° C.) | 6.70 |

Light-fastness test

Densities of green on each sample before and after fading by irradiation of sun light for 35 days by using an under glass outdoor radiation box were measured.

Each degree of fading (fading rate) on the high density part and low density part was determined as follows:

High density part: Evaluation of the part having an optical reflection density of 2.0 before fading $$\text{Fading rate (\%)} = \frac{2.0 - D}{2.0} \times 100$$

Low density part: Evaluation of the part having an optical reflection density of 0.50 before fading $$\text{Fading rate (\%)} = \frac{0.50 - 0.12 - D}{0.50 - 0.12} \times 100$$

Note:
D=Optical reflection density after fading
0.12=Density of unexposed part before fading Processing-stability test As an evaluation of processing-stability, processing process (B) was carried out in the same manner as processing process (A), except that a bleach-fixing solution was added to and mixed with the color-developer of processing process (A) in the ratio of 0.4 ml/l. Thus the density change after processing process (B) at the point where the density 1.5 was given by processing process (A) was assessed.

TABLE 1

| Sample | *1 Magenta Coupler | *2 Solvent | *3 Compound of Formula (II) | Light Fading Rate (%) D = 2.0 | Light Fading Rate (%) D = 0.5 | Density Change due to Processing [B] | Remarks |
|---|---|---|---|---|---|---|---|
| 101 | Comparative A-1 | Comparative V-1 | — | 41 | 86 | +0.19 | Comparative Example |
| 102 | Comparative A-1 | S-4 | — | 38 | 82 | +0.19 | Comparative Example |
| 103 | Comparative A-2 | Comparative V-1 | — | 36 | 84 | −0.25 | Comparative Example |
| 104 | Comparative A-2 | S-4 | — | 34 | 79 | −0.22 | Comparative Example |
| 105 | Comparative A-3 | Comparative V-1 | — | 40 | 80 | −0.30 | Comparative Example |
| 106 | Comparative A-3 | S-4 | — | 33 | 65 | −0.28 | Comparative Example |
| 107 | P-21 | Comparative V-1 | — | 30 | 79 | −0.23 | Comparative Example |
| 108 | P-21 | S-4 | — | 19 | 35 | −0.12 | This Invention |
| 109 | P-21 | S-4 | II-7 | 19 | 28 | −0.12 | This Invention |
| 110 | P-3 | Comparative V-2 | — | 32 | 67 | −0.24 | Comparative Example |
| 111 | P-3 | S-2 | — | 18 | 30 | −0.13 | This Invention |
| 112 | P-23 | Comparative V-1 | — | 29 | 48 | −0.23 | Comparative Example |
| 113 | P-23 | Comparative V-3 | — | 34 | 46 | −0.19 | Comparative Example |
| 114 | P-23 | S-1 | — | 16 | 31 | −0.11 | This Invention |
| 115 | P-23 | S-1 | II-15 | 15 | 16 | −0.11 | This Invention |

Note:
*1 Coating amount of magenta coupler was $3.5 \times 10^{-4}$ mol/m$^2$.
*2 The amount of high-boiling solvent added was twice that of coupler in weight.
*3 The amount of compound of formula (II) added was 0.2 mol per mol of coupler.

Magenta coupler for comparison (A-1)

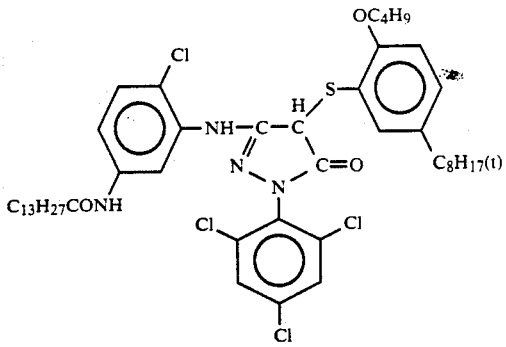

(A-2)

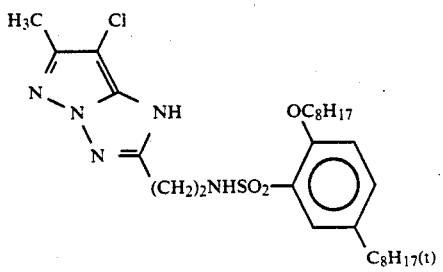

(A-3)

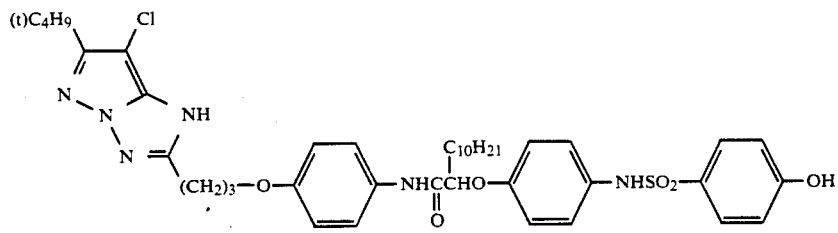

Oil for comparison (V-1)

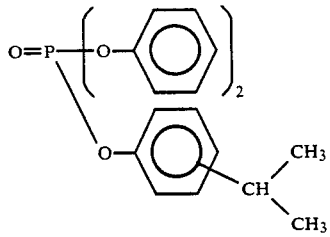

(V-2)

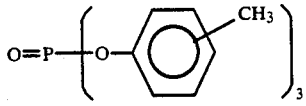

(V-3)

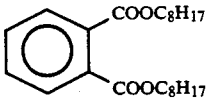

As is apparent from Table 1, in comparison to comparative samples wherein a magenta coupler is dispersed with a high-boiling chlorinated paraffin or a pyrazoloazole-type coupler having a branched alkyl group of formula (I) is used, samples according to the present invention are remarkably improved in fastness to light. With respect to samples according to the present invention, it can be understood that the change in the density of color-formed dyes is suppressed when the samples are processed with a color developer into which a trace amount of a bleach-fix solution had been mixed and the process stability is excellent. The improvement of change in the density of color-formed dye is little even when the group corresponding to $R_1$ in formula (I) bonds to the pyrazoloazole ring through a tertiary carbon atom.

EXAMPLE 2

A multilayer photographic material was prepared by multi-coatings composed of the following layer composition on a two-side polyethylene laminated paper support. Coating solutions were prepared as follows:

Preparation of the first layer coating solution

To a mixture of 19.1 g of yellow coupler (ExY), 4.4 g of image-dye stabilizer (Cpd-1) and 0.7 g of image-dye stabilizer (Cpd-7), 27.2 ml of ethyl acetate and 8.2 g of solvent (Solv-1) were added and dissolved. The resulting solution was dispersed and emulsified in 185 ml of 10% aqueous gelatin solution containing 8 ml of sodium dodecylbenzenesulfonate. Separately another emulsion was prepared by adding two kinds of blue-sensitive sensitizing dye, shown below, to a blend of silver chlorobromide emulsions (cubic grains, 3:7 (silver mol ratio) blend of grains having 0.88 μm and 0.7 μm of average grain size, and 0.08 and 0.10 of deviation coefficient of grain size distribution, respectively, each in which 0.2 mol % of silver bromide was located at the surface of grains) in such amounts that each dye corresponds $2.0\times10^{-4}$ mol to the large size emulsion and $2.5\times10^{-4}$ mol to the small size emulsion, per mol of silver, and then sulfur-sensitized. The thus-prepared emulsion and the above-obtained emulsified dispersion were mixed together and dissolved to give the composition shown below, thereby preparing the first layer coating solution.

Coating solutions for the second to seventh layers were also prepared in the same manner as the first-layer coating solution. As a gelatin hardener for the respective layers, 1-hydroxy-3,5-dichloro-s-treazine sodium salt was used.

As spectral-sensitizing dyes for the respective layers, the following compounds were used:

Blue-sensitive emulsion layer:

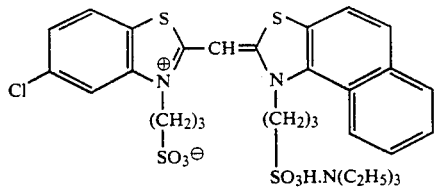

and

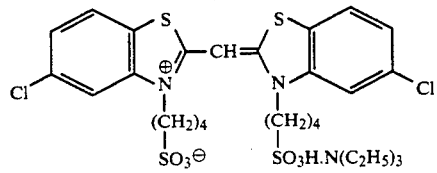

(each $2.0 \times 10^{-4}$ mol to the large size emulsion and $2.5 \times 10^{-4}$ mol to the small size emulsion, per mol of silver halide.)

Green-sensitive emulsion layer:

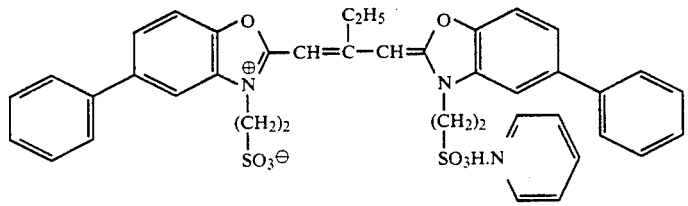

($4.0 \times 10^{-4}$ mol to the large size emulsion and $5.6 \times 10^{-4}$ mol to the small size emulsion, per mol of silver halide)

and

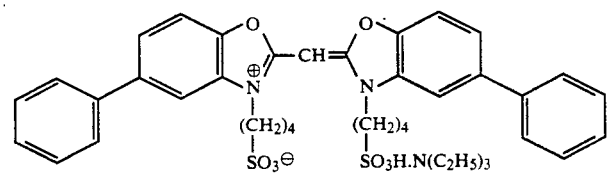

($7.0 \times 10^{-5}$ mol to the large size emulsion and $1.0 \times 10^{-5}$ mol to the small size emulsion, per mol of silver halide)

Red-sensitive emulsion layer:

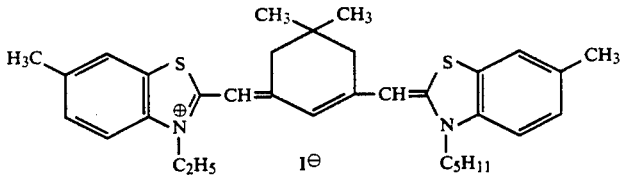

($0.9 \times 10^{-4}$ mol to the large size emulsion and $1.1 \times 10^{-4}$ mol to the small size emulsion, per mol of silver halide)

To the red-sensitive emulsion layer, the following compound was added in an amount of $2.6 \times 10^{-3}$ mol per mol of silver halide:

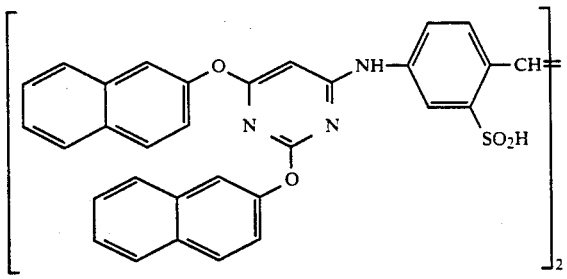

Further, 1-(5-methylureidophenyl)-5-mercaptotetrazole was added to the blue-sensitive emulsion layer, the green-sensitive emulsion layer, and the red-sensitive emulsion layer in amount of $8.5\times10^{-5}$ mol, $7.0\times10^{-4}$ mol, and $2.5\times10^{-4}$ mol, per mol of silver halide, respectively.

The dyes shown below were added to the emulsion layers for prevention of irradiation.

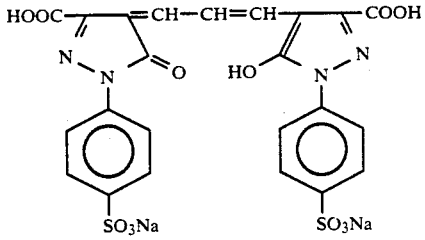

and

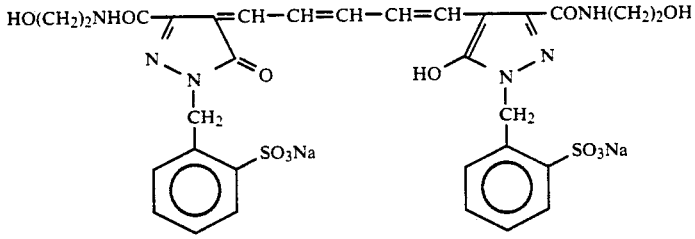

Composition of Layers

The composition of each layer is shown below. The figures represent coating amount (g/m²). The coating amount of each silver halide emulsion is given in terms of silver.

Supporting Base

Paper laminated on both sides with polyethylene (a white pigment, $TiO_2$, and a bluish dye, ultramarine, were included in the first layer side of the polyethylene-laminated film)

| | |
|---|---|
| First Layer (Blue-sensitive emulsion layer): | |
| The above-described silver chlorobromide emulsion | 0.30 |
| Gelatin | 1.86 |
| Yellow coupler (ExY) | 0.82 |
| Image-dye stabilizer (Cpd-1) | 0.19 |
| Solvent (Solv-1) | 0.35 |
| Image-dye stabilizer (Cpd-7) | 0.06 |
| Second Layer (Color-mix preventing layer): | |
| Gelatin | 0.99 |
| Color mix inhibitor (Cpd-5) | 0.08 |
| Solvent (Solv-1) | 0.16 |
| Solvent (Solv-4) | 0.08 |
| Third Layer (Green-sensitive emulsion layer): | |
| Silver chlorobromide emulsions (cubic grains, 1:3 (Ag mol ratio) blend of grains having 0.55 μm and 0.39 μm of average grain size, and 0.10 and 0.08 of deviation coefficient of grain size distribution, respectively, each in which 0.8 mol % of AgBr was located at the surface of grains) | 0.12 |
| Gelatin | 1.24 |
| Magenta coupler | see Table 2 |
| Image-dye stabilizer (Cpd-2) | 0.03 |
| Image-dye stabilizer (Cpd-3) | 0.15 |
| Image-dye stabilizer (Cpd-4) | 0.02 |
| Solvent | see Table 2 |
| Fourth Layer (Ultraviolet absorbing layer): | |
| Gelatin | 1.58 |
| Ultraviolet absorber (UV-1) | 0.47 |
| Color-mix inhibitor (Cpd-5) | 0.05 |
| Solvent (Solv-5) | 0.24 |
| Fifth Layer (Red-sensitive emulsion layer): | |
| Silver chlorobromide emulsions (cubic grains, 1:4 (Ag mol ratio) blend of grains having 0.58 μm and 0.45 μm of average grain size, and 0.09 and 0.11 of deviation coefficient of grain size distribution, respectively, each in which 0.6 mol % of AgBr was located at the surface of grains) | 0.23 |
| Gelatin | 1.34 |
| Cyan coupler (ExC) | 0.32 |
| Image-dye stabilizer (Cpd-6) | 0.17 |
| Image-dye stabilizer (Cpd-7) | 0.40 |
| Image-dye stabilizer (Cpd-8) | 0.04 |
| Solvent (Solv-6) | 0.15 |
| Sixth layer (Ultraviolet ray absorbing layer): | |
| Gelatin | 0.53 |
| Ultraviolet absorber (UV-1) | 0.16 |
| Color-mix inhibitor (Cpd-5) | 0.02 |
| Solvent (Solv-5) | 0.08 |
| Seventh layer (Protective layer): | |
| Gelatin | 1.33 |
| Acryl-modified copolymer of polyvinyl alcohol (modification degree : 17%) | 0.17 |
| Liquid paraffin | 0.03 |

Compounds used are as follows:

(ExY) Yellow coupler
Same as in Example 1
(ExC) Cyan coupler
Mixture (2:4:4 in weight ratio) of
R = $C_2H_5$ and $C_4H_9$ of
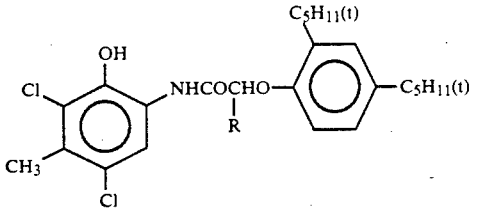
and
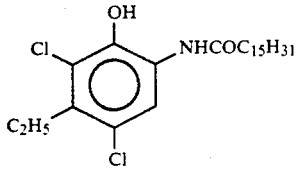
(Cpd-1) Image-dye stabilizer
Same as in Example 1
(Cpd-2) Image-dye stabilizer
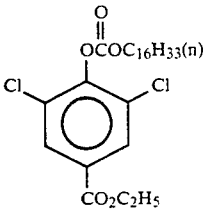
(Cpd-3) Image-dye stabilizer
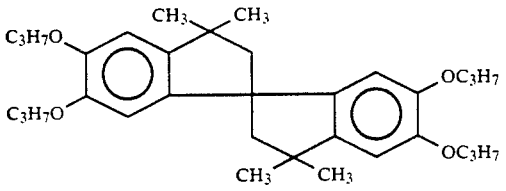
(Cpd-4) Image-dye stabilizer
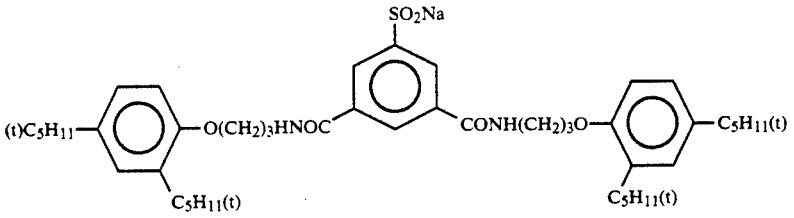
(Cpd-5) Color-mix inhibitor
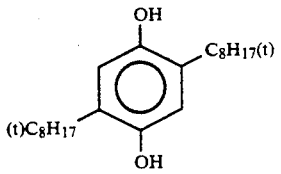
(Cpd-6) Image-dye stabilizer
Mixture (2:4:4 in weight ratio) of -continued
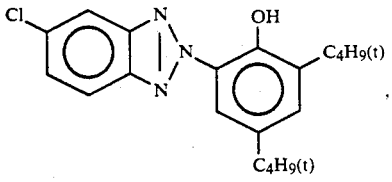
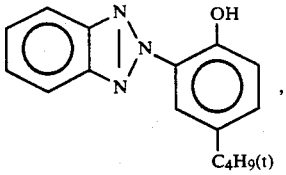
and
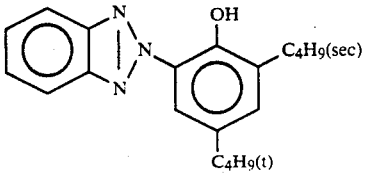
(Cpd-7) Image-dye stabilizer
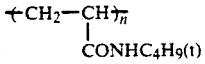
Average molecular weight: 60,000
(Cpd-8) Image-dye stabilizer
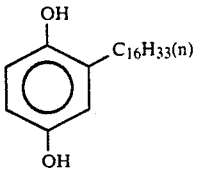
(UV-1) Ultraviolet ray absorber
Same as in Example 1
(Solv-1) Solvent
Same as in Example 1
(Solv-2) Solvent
Mixture (2:1 in volume ratio) of
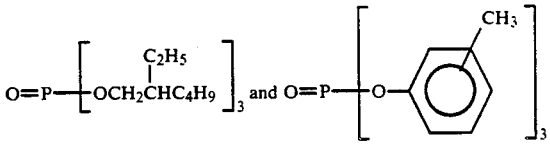
(Solv-3) Solvent
$O{=}P{+}O{-}C_9H_{19}(iso)]_3$
(Solv-4) Solvent
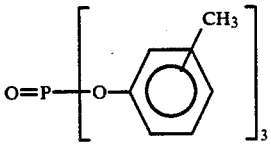
(Solv-5) solvent
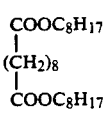

-continued (Solv-6) Solvent

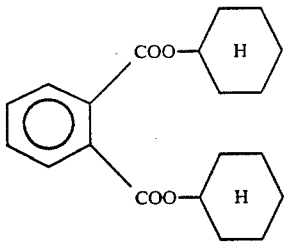

Each of photographic materials above described was subjected to an exposure to light in the same manner as in Example 1.

After exposure to light, each sample was subjected to a continuous processing (running test) by the processing process (B) shown below using a paper-processor, until a volume of color developer twice that of a tank had been replenished.

| Processing process (B) | | | | |
|---|---|---|---|---|
| Processing step | Temperature | Time | Replenisher Amount* | Tank Volume |
| Color developing | 35° C. | 45 sec. | 161 ml | 17 l |
| Bleach-fixing | 30-35° C. | 45 sec. | 215 ml | 17 l |
| Rinsing 1 | 30-35° C. | 20 sec. | — | 10 l |
| Rinsing 2 | 30-35° C. | 20 sec. | — | 10 l |
| Rinsing 3 | 30-35° C. | 20 sec. | 350 ml | 10 l |
| Drying | 70-80° C. | 60 sec. | | |

Note: *Replenisher amount per $m^2$ of the photographic material.

The stabilizing solutions were used in a counter-current flowing system from the tank of stabilizing 4 toward the tank of stabilizing 1.

The compositions of the respective processing solution were as follows:

| Color developer | Tank Solution | Replenisher |
|---|---|---|
| Water | 800 ml | 800 ml |
| Ethylenediamine-N,N,N'-tetramethylene phosphonic acid | 1.5 g | 1.5 g |
| Potassium bromide | 0.015 g | — |
| Triethanolamine | 8.0 g | 12.0 g |
| Natrium chloride | 1.4 g | — |
| Potassium carbonate | 25 g | 25 g |

-continued

| Color developer | Tank Solution | Replenisher |
|---|---|---|
| N-ethyl-N-(β-methanesulfonamidoethyl)-3-methyl-4-aminoaniline sulfate | 5.0 g | 7.0 g |
| Fluorescent brightening agent (WHITEX-4, made by Sumitomo Chem. Ind.) | 1.0 g | 2.5 g |
| Water to make | 1000 ml | 1000 ml |
| pH (25° C.) | 10.05 | 10.45 |
| Bleach-fixing solution (both tank solution and replenisher) | | |
| Water | 400 ml | |
| Ammonium thiosulfate (70%) | 100 ml | |
| Sodium sulfite | 17 g | |
| Iron (III) ammonium ethylenediaminetetraacetate dihydrate | 55 g | |
| Disodium ethylenediaminetetraacetate | 5 g | |
| Ammonium bromide | 40 g | |
| Water to make | 1000 ml | |
| pH (25° C.) | 6.0 | |
| Rinsing solution (both tank solution and replenisher) | | |
| Ion-exchanged water (Calsium and magnesium each are contained 3 ppm or below) | | |

TABLE 2

| Sample | *1 Magenta Coupler | Solvent | *2 Compound of Formula (II) | Light Fading Rate (%) High Density Part | Low Density Part | Density Change | Remarks |
|---|---|---|---|---|---|---|---|
| 201 | A-2 | Comparative V-2 | — | 39 | 80 | −0.33 | Comparative Example |
| 202 | A-2 | S-1 | — | 36 | 76 | −0.31 | Comparative Example |
| 203 | A-3 | Comparative V-2 | — | 43 | 78 | −0.36 | Comparative Example |
| 204 | A-3 | S-2 | — | 37 | 73 | −0.34 | Comparative Example |
| 205 | P-6 | Comparative V-1 | — | 31 | 68 | −0.32 | Comparative Example |
| 206 | P-21 | Comparative V-2 | — | 34 | 74 | −0.29 | Comparative Example |
| 207 | P-23 | Comparative V-2 | — | 32 | 69 | −0.26 | Comparative Example |
| 208 | P-6 | S-3 | — | 17 | 25 | −0.15 | This Invention |
| 209 | P-6 | S-4 | — | 15 | 28 | −0.12 | This Invention |
| 210 | P-21 | S-1 | — | 18 | 27 | −0.12 | This Invention |
| 211 | P-23 | S-4 | — | 16 | 22 | −0.12 | This Invention |
| 212 | P-23 | S-2 | II-18 | 16 | 14 | −0.11 | This Invention |

Note:
*1 The coating amount of magenta coupler was $3.7 \times 10^{-4}$ mol/$m^2$. The ammount of high-boiling solvent was twice that of coupler in weight.
*2 The ammount of compound of formula (II) added was 0.4 mol per mil of coupler.
*3 Light-fading test and processing stability test were the same as in Example 1.

From Table 2, it is apparent that in Samples of the present invention the fastness to light is remarkably excellent from the high-density part to the low-density part, which means the change in balance is small, and the processing stability is excellent. On the other hand, even when the group corresponding to $R_1$ in formula (I) bonds to the pyrazoloazole ring through a tertiary carbon atom, the improvement of change in the density of color-formed dye is little.

Having described our invention as related to the embodiment, it is our intention that the invention not be limited by any of the details of the description, unless otherwise specified, but rather be construed broadly within its spirit and scope as set out in the accompanying claims.

What we claim is:

1. A silver halide color photographic material having at least one silver halide emulsion layer on a base, which comprises, in said silver halide emulsion layer, at least one coupler represented by formula (I):

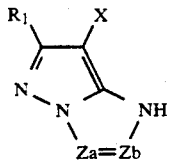

wherein Za and Zb each represent =CH—,

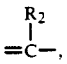

or =N—, $R_1$ represents a hydrogen atom or a substituent, $R_2$ represents a substituent, X represents a hydrogen atom or a group or an atom capable of being released upon the coupling reaction with the oxidized product of an aromatic primary amine developing agent, Za=Zb may be part of the aromatic ring, being a carbon-carbon double bond, a dimer or more higher polymer may be formed through $R_1$, $R_2$, or X $R_2$s may be the same or different when there are two or more $R_2$s in the molecule, and i) when there is no $R_2$ in the molecule, $R_1$ represents a group bonded to the pyrazoloazole ring through a secondary or tertiary carbon atom, or ii) when there is $R_2$ in the molecule, at least one $R_2$ represents a group bonded to the pyrazoloazole ring through a secondary or tertiary carbon atom, which coupler has been dispersed by using at least one chlorinated paraffin having 8 or more carbon atoms, and said silver halide emulsion layer contains at least one compound represented by formula (II):

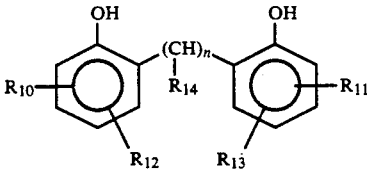

wherein $R_{10}$ and $R_{11}$ each is a methyl group, $R_{12}$ and $R_{13}$ each represent an alkyl group having 1 to 18 carbon atoms, $R_{14}$ is an alkyl group having 3 to 12 carbon atoms, n is an integer of 1 to 3.

2. The silver halide color photographic material is claimed in claim 1, wherein the coupler is selected from the group consisting of compounds represented by formulae (I-1), (I-2), (I-3), (I-4), and (I-5):

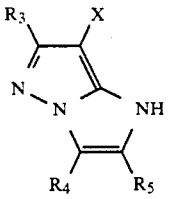

(I-1)

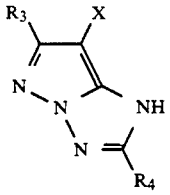

(I-2)

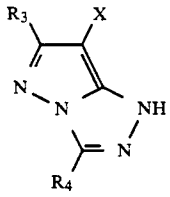

(I-3)

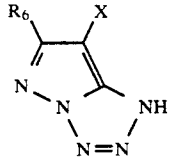

(I-4)

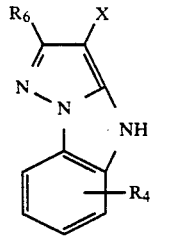

(I-5)

wherein $R_3$ and $R_6$ each correspond to $R_1$ in formula (I), and $R_4$ and $R_5$ each correspond to $R_2$ in formula (I).

3. The silver halide color photographic material as claimed in claim 2, wherein $R_3$, $R_4$, and $R_5$ in formulae (I-1) to (I-3) each represent a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, and acyl group, a sulfamoyl group, a sulfonyl group, a sulfinyl group, an alkoxycarbonyl group, or an aryloxycarbonyl group, and at least one of $R_3$ and $R_4$ in formula (I-1), $R_4$ in formulae (I-2) and (I-3), and $R_6$ in formulae (I-4) and (I-5) represents a group that bonds to the pyrazoloazole ring through a secondary or tertiary carbon atom.

4. The silver halide color photographic material as claimed in claim 1, wherein X is selected from the group consisting of a hydrogen atom, a halogen atom, a carboxy group, or a group capable of being released upon coupling reaction that bonds to the carbon atom at the coupling site through an oxygen atom, a nitrogen atom, or a sulfur atom.

5. The silver halide color photographic material as claimed in claim 1, wherein the coupler represented by formula (I) is contained in a range of 0.1 to 1 mol per mol of the silver halide.

6. The silver halide color photographic material as claimed in claim 1, wherein the chlorinated paraffin is selected from the group consisting of chlorinated straight-chain, branched, and cyclic paraffins, polymers obtained from chlorine-substituted unsaturated hydrocarbon, and copolymers of chlorine-substituted unsaturated hydrocarbon and other olefin.

7. The silver halide color photographic material as claimed in claim 1, wherein the chlorinated paraffin is present in an amount of 0.1 g to 20 g per g of the total amount of magenta couplers.

8. The silver halide color photographic material as claimed in claim 1, wherein the coupler represented by formula (I) is present together with other types of magenta coupler.

9. The silver halide color photographic material as claimed in claim 1, wherein the compound represented by formula (II) is added in an amount of 1 to 100 mol % to the total amount of magenta couplers.

10. The silver halide color photographic material as claimed in claim 1, wherein the chlorinated paraffin is used as a mixture with a high-boiling coupler solvent which is selected from the group consisting of compounds represented by the following formula (III), (IV), (V), (VI), and (VII):

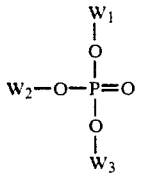

Formula (III)

$W_1—COO—W_2$ Formula (IV)

-continued

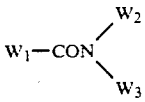

Formula (V)

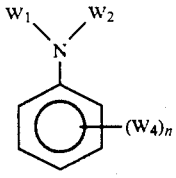

(VI)

$W_1—O—W_2$ Formula (VII)

wherein $W_1$, $W_2$, and $W_3$ each represent a substituted or unsubstituted alkyl group, cycloalkyl group, alkenyl group, aryl group, phenyl group, or heterocyclic group, $W_4$ represents $W_1$, O—$W_1$ or S—$W_1$, n is an integer of 1 to 5, when n is 2 or over, $W_4$ groups may be the same or different, and in formula (VII), $W_1$ and $W_2$ may together form a condensed ring.

11. The silver halide color photographic material as claimed in claim 10, wherein the boiling point of the high-boiling coupler solvent is 160° C. or over.

12. The silver halide color photographic material as claimed in claim 1, wherein the molecular weight of said chlorinated paraffins is between 250 and 10,000.

13. The silver halide color photographic material as claimed in claim 1, wherein the boiling point of the chlorinated paraffins is 175° C., or over at atmospheric pressure.

14. The silver halide color photographic material as claimed in claim 1, wherein the compound represented by formula (II) and the coupler of formula (I) are co-emulsified.

15. The silver halide color photographic material as claimed in claim 1, wherein the compound represented by formula (II) is represented by formula (II-a):

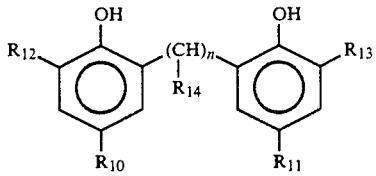

wherein $R_{10}$ to $R_{14}$ have the same meaning as in formula (II).

* * * * *